US009830882B2

(12) United States Patent
Yata et al.

(10) Patent No.: US 9,830,882 B2
(45) Date of Patent: Nov. 28, 2017

(54) DISPLAY DEVICE AND COLOR CONVERSION METHOD

(71) Applicant: Japan Display Inc., Tokyo (JP)

(72) Inventors: Tatsuya Yata, Tokyo (JP); Takayuki Nakanishi, Tokyo (JP)

(73) Assignee: Japan Display Inc., Tokyo (JP)

( * ) Notice: Subject to any disclaimer, the term of this patent is extended or adjusted under 35 U.S.C. 154(b) by 0 days.

(21) Appl. No.: 14/966,014

(22) Filed: Dec. 11, 2015

(65) Prior Publication Data

US 2016/0171955 A1 Jun. 16, 2016

(30) Foreign Application Priority Data

Dec. 15, 2014 (JP) ..... 2014-253351

(51) Int. Cl.

| | |
|---|---|
| ***G09G 5/06*** | (2006.01) |
| ***G09G 5/04*** | (2006.01) |
| ***G09G 5/02*** | (2006.01) |
| ***G09G 3/36*** | (2006.01) |
| *G09G 5/10* | (2006.01) |

(52) U.S. Cl.

CPC ..... *G09G 5/02* (2013.01); *G09G 3/3607* (2013.01); *G09G 5/04* (2013.01); *G09G 5/10* (2013.01); *G09G 2300/0452* (2013.01); *G09G 2320/0626* (2013.01); *G09G 2320/0646* (2013.01); *G09G 2320/0666* (2013.01); *G09G 2330/021* (2013.01); *G09G 2330/045* (2013.01); *G09G 2340/06* (2013.01); *G09G 2360/144* (2013.01); *G09G 2360/16* (2013.01)

(58) Field of Classification Search

CPC ..... G09G 5/02; G09G 3/2003; G09G 3/3225; G09G 2300/0452; G09G 2360/16; G09G 2330/021; G09G 2340/06; G09G 2320/061

USPC ..... 345/601, 604

See application file for complete search history.

(56) References Cited

U.S. PATENT DOCUMENTS

| | | | | |
|---|---|---|---|---|
| 2004/0113875 | A1* | 6/2004 | Miller | G09G 3/3216 345/82 |
| 2005/0073262 | A1* | 4/2005 | Cok | G09G 3/3216 315/169.3 |
| 2005/0184998 | A1 | 8/2005 | Yang et al. | |
| 2007/0115392 | A1* | 5/2007 | Masuda | H04N 5/20 348/678 |

(Continued)

FOREIGN PATENT DOCUMENTS

| | | |
|---|---|---|
| JP | 2005242300 | 9/2005 |

*Primary Examiner* — Gregory J Tryder
*Assistant Examiner* — Michael Le
(74) *Attorney, Agent, or Firm* — K & L Gates LLP

(57) ABSTRACT

According to an aspect, a display device includes: an image display unit in which pixels each including a plurality of sub-pixels are arranged in a matrix, the sub-pixels displaying a plurality of color components; and a signal processing unit that performs color conversion on an input video signal and outputs the resultant signal to a drive circuit that controls drive of the image display unit. The signal processing unit performs color conversion on first color information so as to increase luminance within an allowance range of a change in at least one of a hue and saturation, to generate second color information, the first color information being composed of three primary colors of red, green, and blue and derived based on the input video signal.

12 Claims, 25 Drawing Sheets

(56) References Cited

U.S. PATENT DOCUMENTS

| | | | | |
|---|---|---|---|---|
| 2008/0272999 | A1* | 11/2008 | Kurokawa | G09G 3/3406 345/89 |
| 2013/0044146 | A1* | 2/2013 | Kurokawa | G09G 3/3406 345/690 |
| 2014/0225933 | A1* | 8/2014 | Park | G09G 5/10 345/690 |

* cited by examiner

DISPLAY DEVICE AND COLOR CONVERSION METHOD

CROSS REFERENCES TO RELATED APPLICATIONS

The present application claims priority to Japanese Priority Patent Application JP 2014-253351 filed in the Japan Patent Office on Dec. 15, 2014, the entire content of which is hereby incorporated by reference.

BACKGROUND

The present invention relates to a display device and a color conversion method.

Description of the Related Art

Conventionally widely used are liquid crystal display devices provided with an RGBW liquid crystal display panel including pixels W (white) besides pixels R (red), G (green), and B (blue) as an image display unit that displays an image (refer to Japanese Patent Application Laid-open Publication No. 2005-242300). Such RGBW liquid crystal display devices display an image by allocating, to the pixels W, light transmitted from a light source through the pixels R, G, and B based on RGB data that determines image display. Thus, the RGBW liquid crystal display devices can increase the light use efficiency in the entire liquid crystal display panel, thereby reducing the light source luminance required to maintain the luminance of the display image. In the case of a transmissive liquid crystal display panel, the RGBW liquid crystal display devices can reduce the luminance of a backlight, thereby reducing power consumption.

To reduce the light source luminance required to maintain the luminance of a display image, the conventional RGBW display devices perform image extension on an input image signal. In the image extension, the conventional RGBW display devices replace a portion common to image data of the red pixel, the green pixel, and the blue pixel with image data of the white pixel. Subsequently, the conventional RGBW display devices extend the image data of each pixel resulting from the replacement, thereby increasing the amount of light transmitted through each pixel. Thus, the conventional RGBW display devices can increase the light use efficiency in the entire liquid crystal display panel, thereby reducing the light source luminance required to maintain the luminance of the display image.

In a case where the RGB data in the input image signal includes data having higher saturation and/or brightness or where the gradation values of data of respective colors significantly differ from one another, there is less room for the conventional RGBW display devices to perform image extension after converting the RGB data into RGBW data. As a result, there is less room for the RGBW display devices to improve the light use efficiency in the entire liquid crystal display panel. Especially in the case of a transmissive liquid crystal panel, there is less room for the RGBW liquid crystal display devices may possibly to reduce the luminance of the backlight, thereby failing to reduce power consumption.

For the foregoing reasons, there is a need for a display device and a color conversion method that can improve the light use efficiency in a liquid crystal display panel.

SUMMARY

According to an aspect, a display device includes: an image display unit in which pixels each including a plurality of sub-pixels are arranged in a matrix, the sub-pixels displaying a plurality of color components; and a signal processing unit that performs color conversion on an input video signal and outputs the resultant signal to a drive circuit that controls drive of the image display unit. The signal processing unit performs color conversion on first color information so as to increase luminance within an allowance range of a change in at least one of a hue and saturation, to generate second color information, the first color information being composed of three primary colors of red, green, and blue and derived based on the input video signal.

According to another aspect, a color conversion method for an input signal supplied to a drive circuit for an image display unit having a plurality of pixels each including a first sub-pixel that displays a red component, a second sub-pixel that displays a green component, a third sub-pixel that displays a blue component, and a fourth sub-pixel that is different from the first sub-pixel, the second sub-pixel, and the third sub-pixel, and displays an additional color component capable of being expressed by the first sub-pixel, the second sub-pixel, and the third sub-pixel, light use efficiency when the additional color component is expressed by the fourth sub-pixel being higher than that when the additional color component is expressed by the first sub-pixel, the second sub-pixel, and the third sub-pixel, the color conversion method includes: performing color conversion on first color information composed of three primary colors of red, green, and blue and derived based on an input video signal so as to increase luminance within an allowance range of a change in at least one of a hue and saturation, to generate second color information; converting the second color information into third color information having the red component, the green component, the blue component, and the additional color component; and performing data extension on the third color information.

Additional features and advantages are described herein, and will be apparent from the following Detailed Description and the figures.

DETAILED DESCRIPTION

Figure 1:
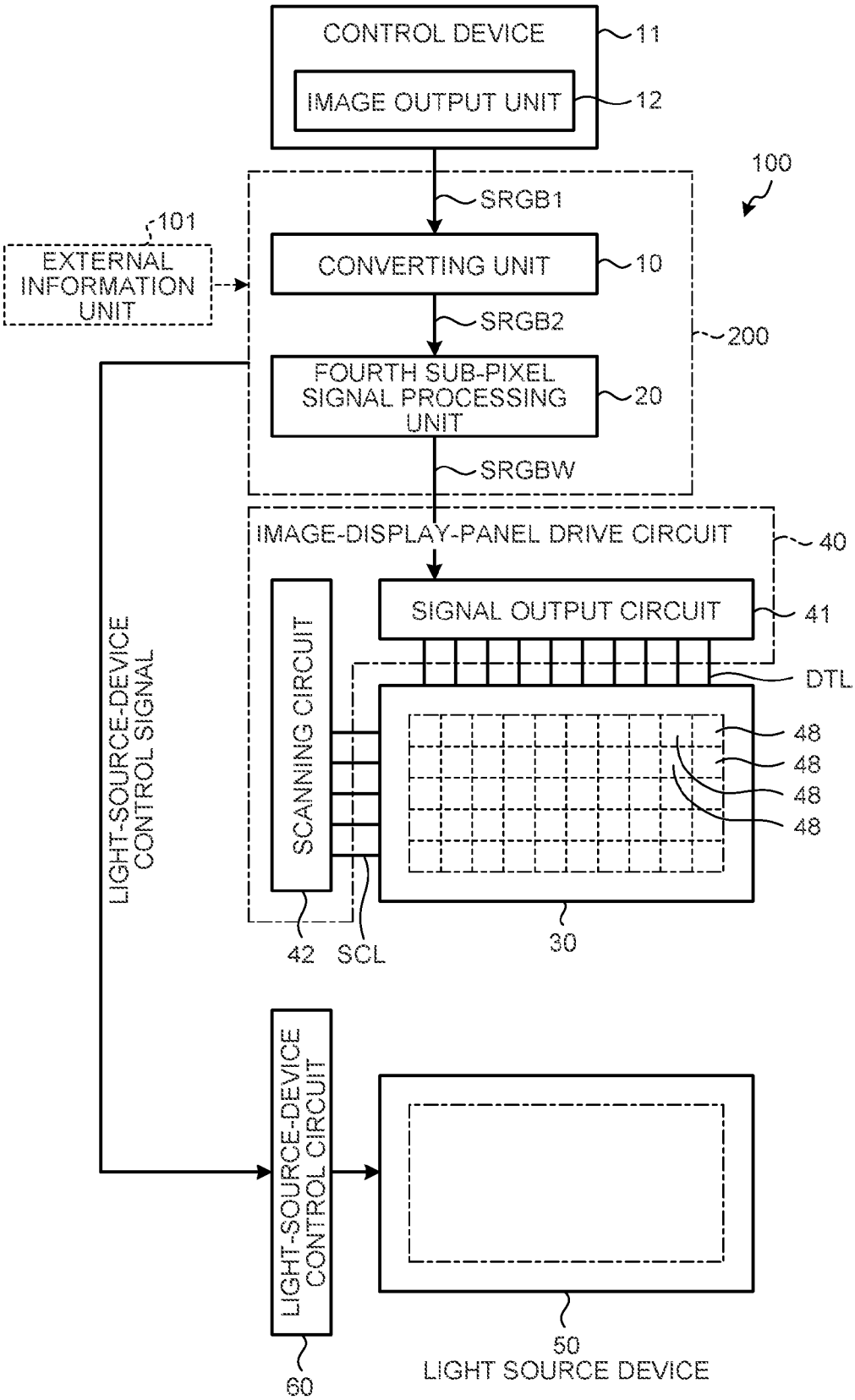
FIG. 1 is a block diagram of an exemplary configuration of a display device according to an embodiment.

Exemplary embodiments according to the present invention are described below in greater detail with reference to the accompanying drawings. The contents described in the embodiments are not intended to limit the present invention. Components described below include components easily conceivable by those skilled in the art and components substantially identical therewith. The components described below may be appropriately combined. The disclosure is given by way of example only, and various changes and modifications made without departing from the spirit of the invention and easily conceivable by those skilled in the art are naturally included in the scope of the invention. To simplify the description, the drawings may possibly illustrate the width, the thickness, the shape, and other elements of each unit more schematically than the actual aspect. These elements, however, are given by way of example only and are not intended to limit interpretation of the invention. In the specification and the figures, components similar to those previously described with reference to a preceding figure are denoted by the same reference numerals, and detailed description thereof will be appropriately omitted.

Configuration of Display Device

Figure 2:
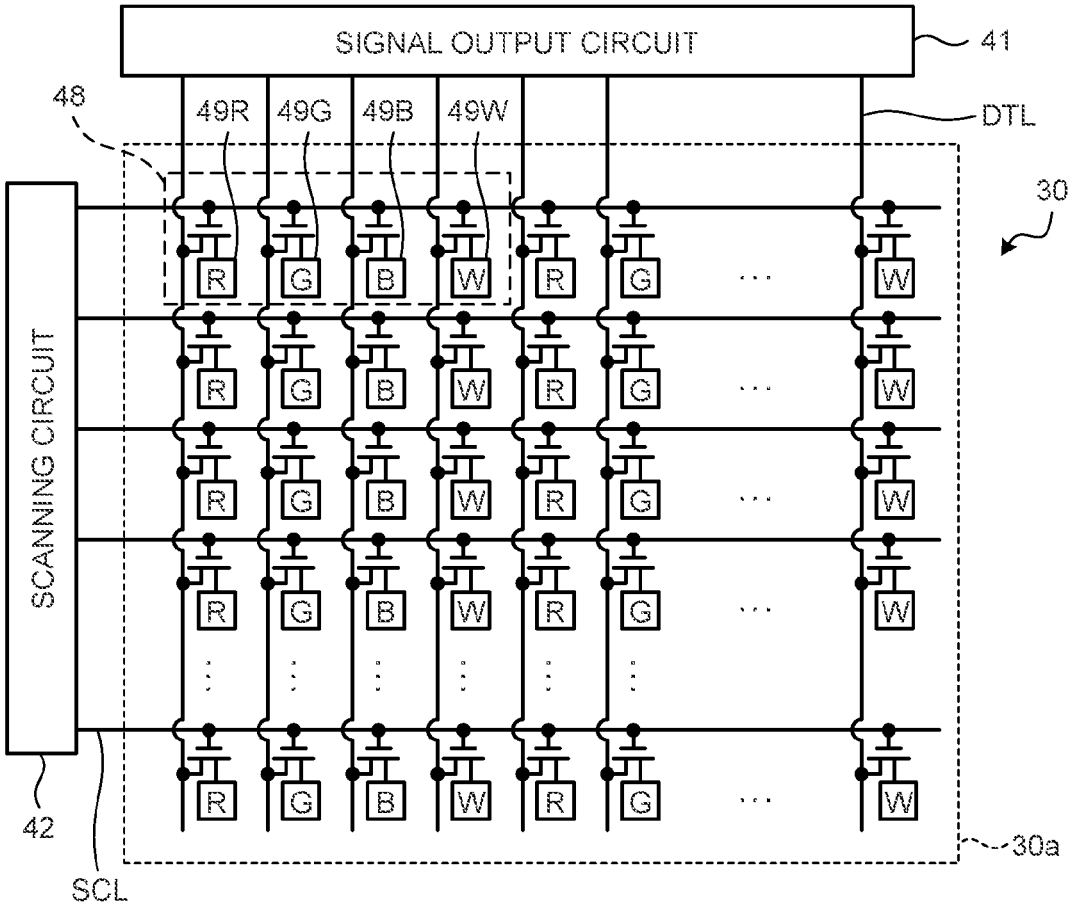
FIG. 2 is a schematic diagram of an image display panel in the display device illustrated in FIG. 1.

FIG. 1 is a block diagram of an exemplary configuration of a display device according to an embodiment. FIG. 2 is a schematic diagram of an image display panel in the display device illustrated in FIG. 1.

As illustrated in FIG. 1, a display device 100 includes a converting unit 10, a fourth sub-pixel signal processing unit 20, an image display unit 30, an image-display-panel drive circuit 40 (hereinafter, also referred to as a drive circuit 40), a light source device 50, and a light-source-device control circuit (light source control unit) 60. The image display unit 30 serves as an image display panel. The image-display-panel drive circuit 40 controls drive of the image display unit 30. The light source device 50 outputs white light to an image display area 30*a* (because it is not illustrated in FIG. 1, refer to FIG. 2) of the image display unit 30 from the back surface of the image display unit 30. The light-source-device control circuit 60 controls operations of the light source device 50.

The display device 100 may be various modifications described in Japanese Patent No. 3167026, Japanese Patent No. 3805150, Japanese Patent No. 4870358, Japanese Patent Application Laid-open Publication No. 2011-90118, and Japanese Patent Application Laid-open Publication No. 2006-3475.

The functions of the converting unit 10 and the fourth sub-pixel signal processing unit 20 may be provided by hardware or software and are not limited. In a case where respective circuits of the converting unit 10 and the fourth sub-pixel signal processing unit 20 are provided by hardware, the circuits are not necessarily provided physically individually. The functions may be provided by a physically single circuit. A signal processing unit 200 according to the present embodiment includes the converting unit 10 and the fourth sub-pixel signal processing unit 20.

The signal processing unit 200 is an arithmetic processing unit that controls operations of the image display unit 30 and the light source device 50. The signal processing unit 200 is electrically coupled to the image-display-panel drive circuit 40 that drives the image display unit 30 and to the light-source-device control circuit 60 that drives the light source device 50. The signal processing unit 200 performs data processing on an input signal (RGB data) received from the outside and outputs an output signal to the image-display-panel drive circuit 40. The signal processing unit 200 also generates a light-source-device control signal and outputs it to the light-source-device control circuit 60.

The display device 100 may further include an external information unit 101 that measures the illuminance of external light or the like and receives information outside the display device, which will be described later in a third embodiment. Alternatively, the display device 100 may acquire information on the illuminance of external light from the external information unit 101 provided outside the display device 100 and transmit it to the signal processing unit 200.

The converting unit 10 receives first color information as a first input signal SRGB1. The first color information is derived based on an input video signal received from an image output unit 12 of a control device 11 and used to perform display on a predetermined pixel. The converting unit 10 converts the first color information corresponding to an input value in an HSV (Hue-Saturation-Value, Value is also called Brightness) color space into second color information as a second input signal SRGB2. Specifically, the converting unit 10 reduces the saturation by a saturation attenuation amount within an allowable range of a change in the saturation, thereby generating and outputting the second input signal SRGB2. The first color information and the second color information are three-color input signals (R, G, B) each including a red (R) component, a green (G) component, and a blue (B) component.

The fourth sub-pixel signal processing unit 20 is coupled to the image-display-panel drive circuit 40 that drives the image display unit 30. The fourth sub-pixel signal processing unit 20, for example, converts an input value (second input signal SRGB2) of an input signal in the input HSV color space into an extended value (third input signal SRGBW) in an HSV color space extended by a first color, a second color, a third color, and a fourth color. The fourth sub-pixel signal processing unit 20 then outputs the extended value that is generated as an output signal to the image display unit 30. Thus, the fourth sub-pixel signal processing unit 20 converts the second color information in the second input signal SRGB2 into the third input signal SRGBW including third color information having the R component, the G component, the B component, and a white (W) component, which is an additional color component. The fourth sub-pixel signal processing unit 20 then outputs the third input signal SRGBW to the drive circuit 40. The third color information is a four-color input signal (R, G, B, W). The additional color component is what is called a pure white component represented by respective gradations of the R component, the G component, and the B component of 256, that is, (R, G, B)□(255, 255, 255), for example. The embodiment is not limited thereto, and the color conversion may be performed such that a color component represented by, for example, (R, G, B)=(255, 230, 204) is displayed by a four sub-pixels as the additional color component.

While the present embodiment describes the conversion as processing for converting an input signal (e.g., RGB) into a signal in the HSV space, for example, the conversion is not limited thereto. The input signal may be converted into a signal in an XYZ space, a YUV space, or any other coordinate system. The color gamut of a display, such as sRGB and Adobe (registered trademark) RGB, is represented by a triangular range on the xy chromaticity range in the XYZ color system. The predetermined color space indicating a defined color gamut is not necessarily represented by the triangular range and may be represented by a range of a desired shape, such as a polygon.

The fourth sub-pixel signal processing unit 20 outputs the generated output signal to the image-display-panel drive circuit 40.

As illustrated in FIG. 2, the image display unit 30 is a transmissive color liquid crystal display device including the image display area 30*a*. In the image display area 30*a*, pixels 48 are arrayed in a two-dimensional matrix. The pixels 48 each include a first sub-pixel 49R that displays the first color (red), a second sub-pixel 49G that displays the second color (green), a third sub-pixel 49B that displays the third color (blue), and a fourth sub-pixel 49W that displays a fourth color (white). A first color filter that transmits light of the first color (red) is arranged between the first sub-pixel 49R and a display surface of the image display unit 30. A second color filter that transmits light of the second color (green) is arranged between the second sub-pixel 49G and the display surface of the image display unit 30. A third color filter that transmits light of the third color (blue) is arranged between the third sub-pixel 49B and the display surface of the image display unit 30. A fourth color filter that transmits light of the fourth color (white) is arranged between the fourth sub-pixel 49W and the display surface of the image display unit 30. Alternatively, a transparent resin layer that transmits all colors is arranged between the fourth sub-pixel 49W and the display surface of the image display unit 30. No filter may be provided between the fourth sub-pixel 49W and the display surface of the image display unit 30.

In the example illustrated in FIG. 2, the first sub-pixels 49R, the second sub-pixels 49G, the third sub-pixels 49B, and the fourth sub-pixels 49W in the image display unit 30 are arranged in an array similar to a striped array. The configuration and the arrangement of the sub-pixels included in one pixel are not limited. The first sub-pixels 49R, the second sub-pixels 49G, the third sub-pixels 49B, and the fourth sub-pixels 49W in the image display unit 30 may be arranged in an array similar to a diagonal array (mosaic array), for example. Alternatively, the first sub-pixels 49R, the second sub-pixels 49G, the third sub-pixels 49B, and the fourth sub-pixels 49W may be arranged in an array similar to a deltaic array (triangular array) or a rectangular array, for example. Typically, the array similar to a striped array is suitably used for a personal computer and the like to display data and character strings. By contrast, the array similar to a mosaic array is suitably used for a video camera recorder, a digital still camera, and the like to display a natural image.

The image-display-panel drive circuit 40 includes a signal output circuit 41 (signal output unit) and a scanning circuit 42. The signal output circuit 41 is electrically coupled to the sub-pixels in each pixel 48 of the image display unit 30 via wiring DTL. The signal output circuit 41 outputs a drive voltage to be applied to liquid crystals included in each sub-pixel based on an output signal output from the signal processing unit 200. Thus, the signal output circuit 41 controls the transmittance of light output from the light source device 50 through each pixel 48. The scanning circuit 42 is electrically coupled to switching elements that control operations of the sub-pixels included in each pixel 48 of the image display unit 30 via wiring SCL. The scanning circuit 42 sequentially outputs a scanning signal to a plurality of pieces of wiring SCL. Thus, the scanning circuit 42 applies the scanning signal to the switching elements of the respective sub-pixels in each pixel 48, thereby turning on the sub-pixels. The signal output circuit 41 applies a drive voltage to the liquid crystals included in the sub-pixels to which the scanning signal is applied by the scanning circuit 42. Thus, an image is displayed on the entire image display area 30*a* of the image display unit 30.

The light source device 50 is a backlight including various types of light sources and is arranged on the back surface of the image display unit 30. The light source device 50 outputs light from the light source to the image display unit 30, thereby lighting up the image display unit 30.

The light-source-device control circuit 60 controls the amount of light output from the light source device 50 to the image display unit 30 based on a light-source-device control signal output from the signal processing unit 200.

Figure 3:
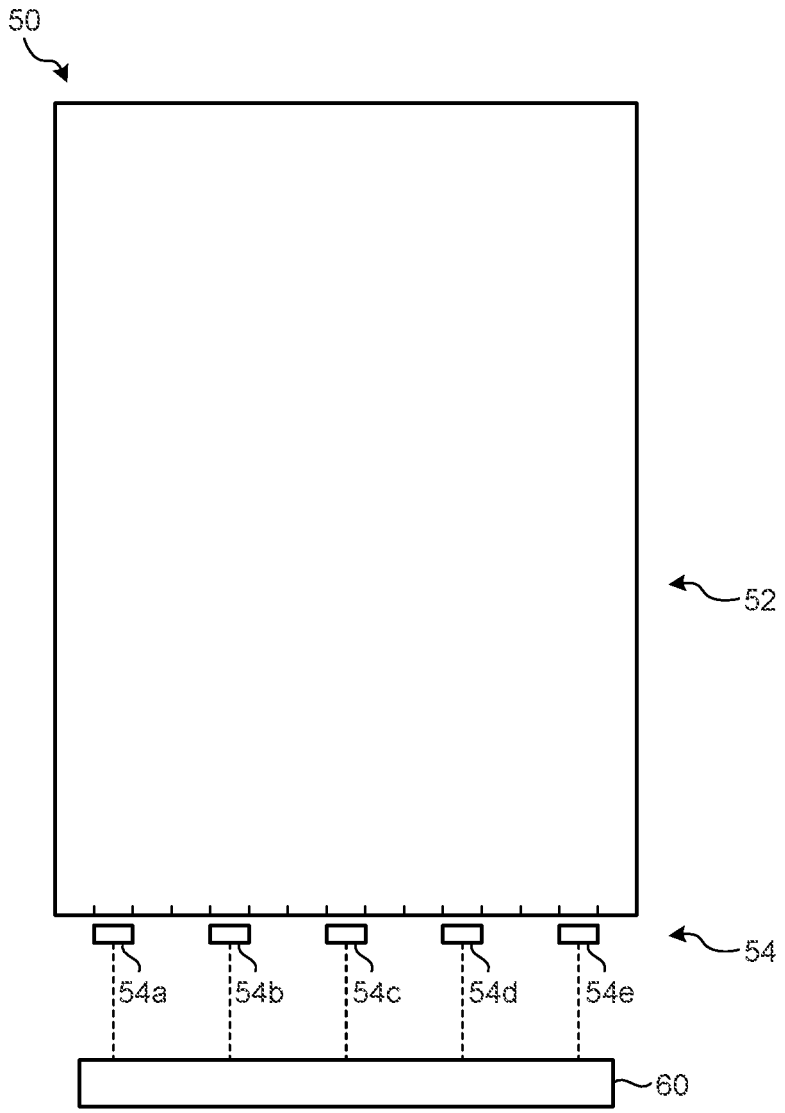
FIG. 3 is a schematic view of a light source device according to the present embodiment.

FIG. 3 is a schematic view of the light source device 50 according to the present embodiment. As illustrated in FIG. 3, the light source device 50 includes a light guide plate 52 and a light source 54 arranged near the end surface of the light guide plate 52. The light source 54 includes five light-emitting diodes (LEDs) 54*a* to 54*e* serving as point light sources arranged side by side at predetermined intervals along one direction. The light-emitting surface of the light guide plate 52 is provided with a kind of optical sheet (not illustrated). The surface opposite to the light-emitting surface of the light guide plate 52 is provided with a reflection sheet (not illustrated). The five LEDs 54*a* to 54*e* are electrically coupled to the light-source-device control circuit 60. The light guide plate 52 guides light output from the five LEDs 54*a* to 54*e* from the end surface to the inside thereof. The light guide plate 52 then outputs the guided light from the principal surface to the image display unit 30. While the light source 54 according to the present embodiment is composed of the five LEDs 54*a* to 54*e*, for example, the number of LEDs 54*a* to 54*e* constituting the light source 54 can be appropriately changed. The light source 54 is not limited to the LEDs 54*a* to 54*e* and may be various types of point light sources and line light sources.

Figure 4:
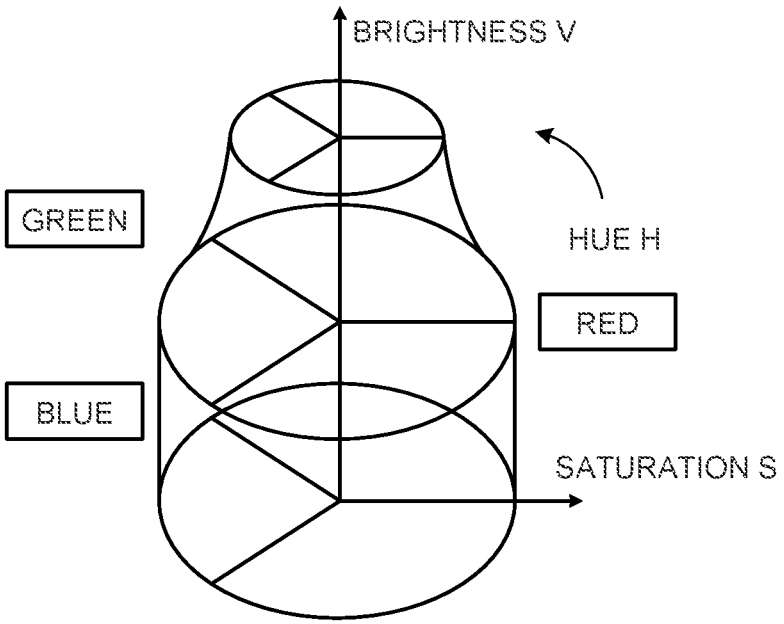
FIG. 4 is a conceptual diagram of an HSV color space extendable by the display device according to the present embodiment.
Figure 5:
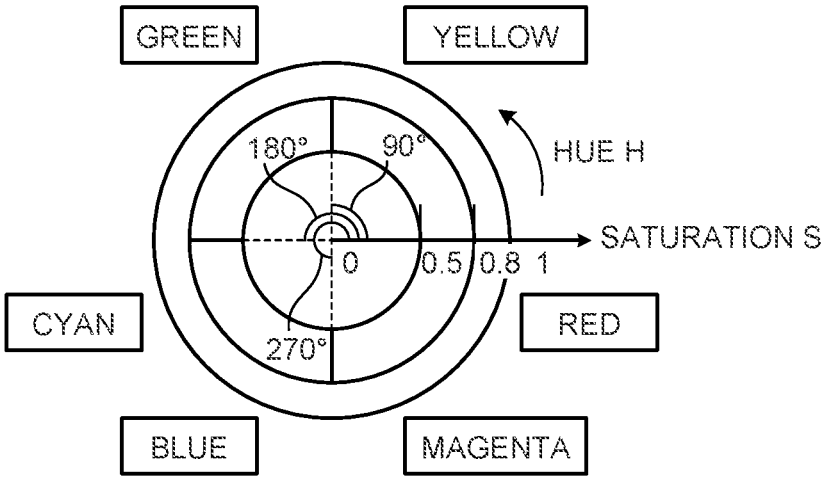
FIG. 5 is a conceptual diagram of a relation between hue and saturation in the HSV color space.

FIG. 4 is a conceptual diagram of an HSV color space extendable by the display device according to the present embodiment. FIG. 5 is a conceptual diagram of a relation between the hue and the saturation in the HSV color space. By including the fourth sub-pixel 49W that outputs the fourth color (white) in the pixel 48, the display device 100 can broaden the dynamic range of brightness in the HSV color space as illustrated in FIG. 4. In other words, the HSV color space has the shape illustrated in FIG. 4: a substantially truncated-cone-shaped solid is placed on a cylindrical HSV color space displayable by the first sub-pixel 49R, the second sub-pixel 49G, and the third sub-pixel 49B. In the truncated-cone-shaped solid, the maximum value of brightness V decreases as saturation S increases.

The first input signal SRGB1 has the input signal of the respective gradations of the R component, the G component, and the B component as the first color information. The first input signal SRGB1 corresponds to the cylindrical portion in the HSV color space, that is, the information on the cylindrical portion in the HSV color space illustrated in FIG. 4.

As illustrated in FIG. 5, a hue H is expressed by 0□ to 360□. The hue H varies in order of red, yellow, green, cyan, blue, magenta, and red from 0□ to 360□. In the present embodiment, the region including an angle of 0□ corresponds to red, the region including an angle of 120□ corresponds to green, and the region including an angle of 240□ corresponds to blue.

First Embodiment

Figure 6:
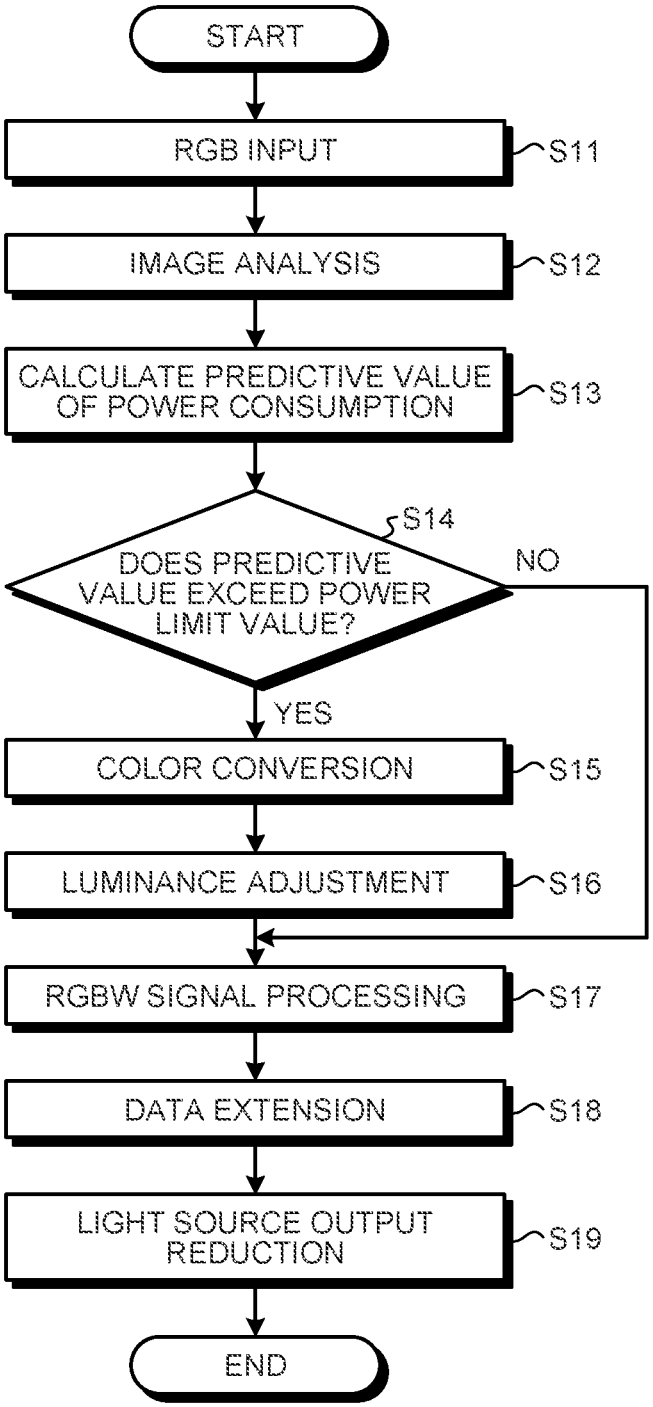
FIG. 6 is a flowchart for illustrating a color conversion method according to a first embodiment.
Figure 7:
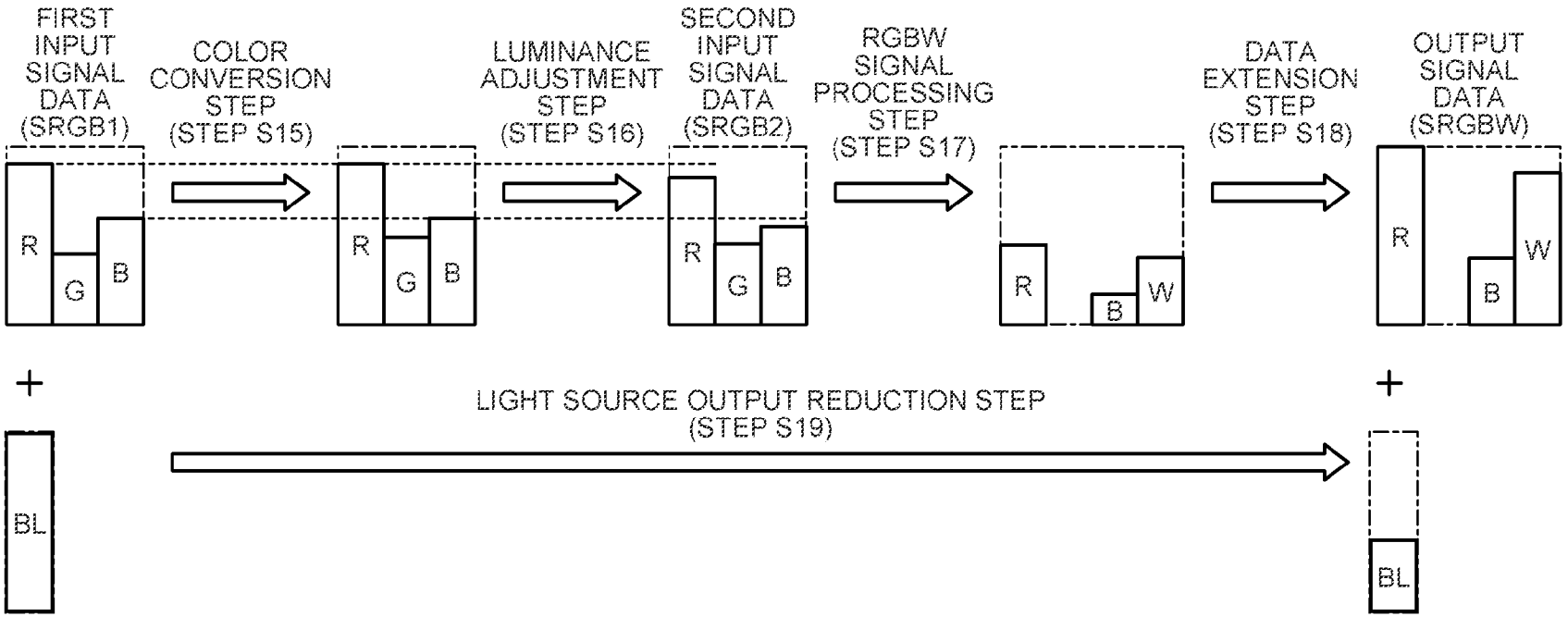
FIG. 7 is a schematic diagram for illustrating exemplary color conversion according to the first embodiment.

FIG. 6 is a flowchart for illustrating a color conversion method according to a first embodiment. FIG. 7 is a schematic diagram for illustrating exemplary color conversion according to the first embodiment.

As illustrated in FIG. 6, the converting unit 10 according to the first embodiment receives the first color information as the first input signal SRGB1. The first color information is derived based on an input video signal and used to perform display on a predetermined pixel (Step S11). The first color information is subjected to gamma conversion as needed, whereby a value in the RGB coordinate system is converted into an input value in the HSV color space.

The converting unit 10 performs an image analysis on the input video signal in an image analysis step (Step S12). Alternatively, the converting unit 10 acquires image analysis information on the input video signal calculated by other processing at the image analysis step (Step S12).

Figure 8:
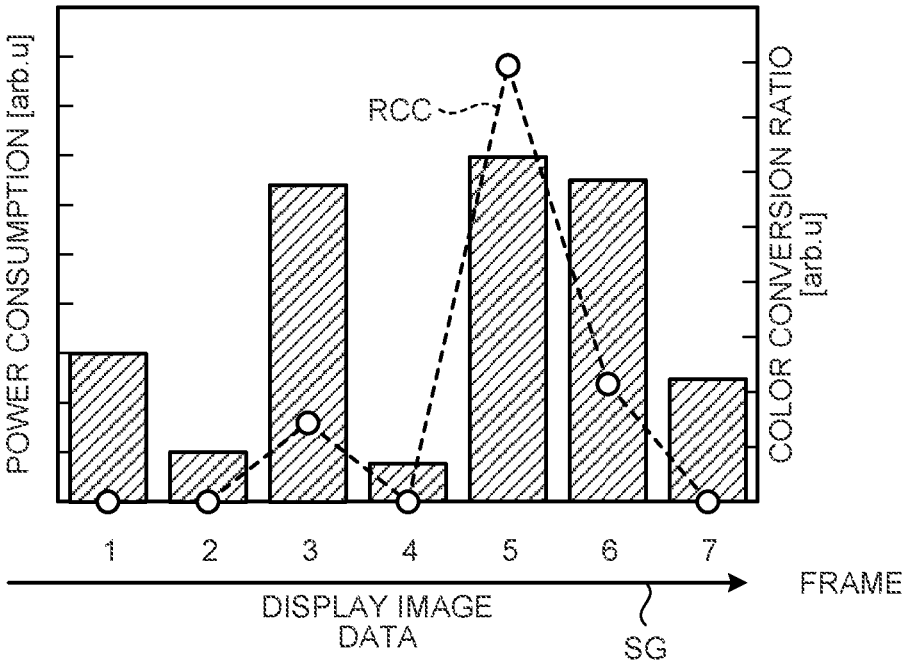
FIG. 8 is a diagram for illustrating fluctuations in a color conversion ratio with respect to a predictive value of power consumption per frame of display image data in an input video signal according to the first embodiment.
Figure 9:
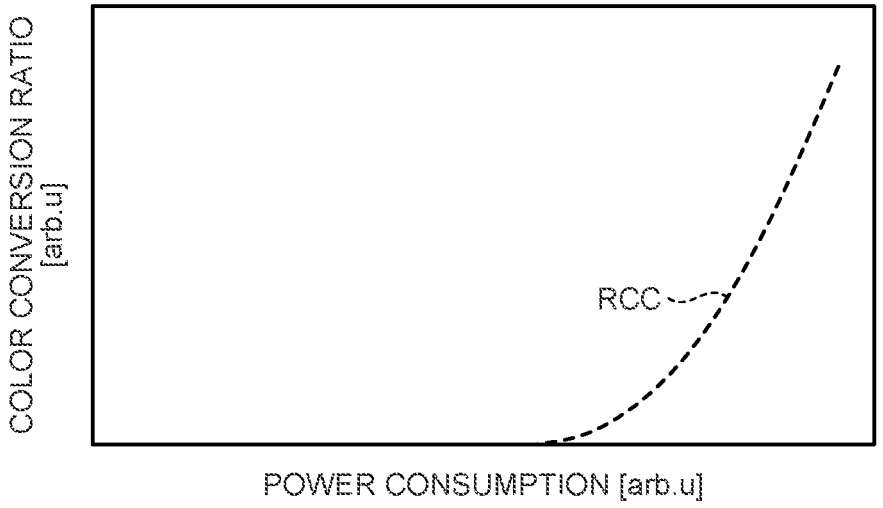
FIG. 9 is a diagram for illustrating a look-up table indicating the color conversion ratio with respect to the predictive value of power consumption according to the first embodiment.

Based on the result of the image analysis performed on the input video signal, the converting unit 10 performs a power consumption prediction step for calculating a predictive value of power consumption (Step S13). FIG. 8 is a diagram for illustrating fluctuations in a color conversion ratio with respect to the predictive value of power consumption per frame of display image data in the input video signal according to the first embodiment. FIG. 9 is a diagram for illustrating a look-up table indicating the color conversion ratio with respect to the predictive value of power consumption according to the first embodiment.

The predictive value of power consumption is derived by calculating the power consumption per frame from the first color information for performing display on the predetermined pixel based on the first input signal SRGB1 received at Step S11. As a result, it is found that the power consumption fluctuates depending on display image data SG in the input video signal per frame as illustrated in FIG. 8.

The converting unit 10 according to the first embodiment stores therein a power limit value as a set value in advance.

As illustrated in FIG. 6, if the predictive value of power consumption does not exceed a threshold of the power limit value (No at Step S14), the converting unit 10 performs processing at Step S17. Because the frames 1, 2, 4, and 7 illustrated in FIG. 8, for example, have a predictive value of power consumption not exceeding the threshold of the power limit value, the color conversion ratio is reduced.

As illustrated in FIG. 6, if the predictive value of power consumption exceeds the threshold of the power limit value (Yes at Step S14), the converting unit 10 performs processing at Step S15. The converting unit 10 stores therein in advance the look-up table indicating the color conversion ratio with respect to the predictive value of power consumption illustrated in FIG. 9. Alternatively, the converting unit 10 may store therein a conversion formula for calculating the color conversion ratio with respect to the predictive value of power consumption illustrated in FIG. 9. The converting unit 10 simply needs to have information on the color conversion ratio with respect to the predictive value of power consumption to calculate the relation of the color conversion ratio with respect to the predictive value of power consumption.

The converting unit 10 according to the first embodiment calculates a color conversion ratio RCC based on the predictive value of power consumption calculated at the power consumption prediction step (Step S13) and the information on the color conversion ratio with respect to the predictive value of power consumption illustrated in FIG. 9. Thus, the converting unit 10 according to the first embodiment can calculate the color conversion ratio RCC based on the power consumption fluctuating depending on the display image data SG in the input video signal per frame as illustrated in FIG. 8. As illustrated in FIG. 8, for example, the frame 5 has a predictive value of power consumption exceeding the threshold of the power limit value. To maintain desired luminance with power consumption of equal to or smaller than a limited power consumption amount, the color conversion ratio needs to be increased as illustrated in FIG. 9.

The converting unit 10 according to the first embodiment performs at least one of a hue conversion step and a saturation conversion step, which will be described below, in a color conversion step (Step S15).

Figure 10:
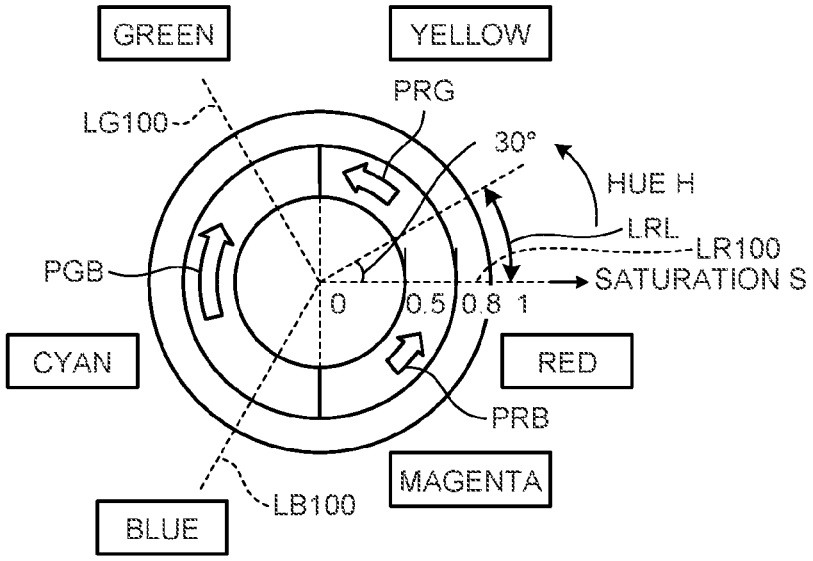
FIG. 10 is a conceptual diagram of hue conversion in the HSV color space according to the first embodiment.
Figure 11:
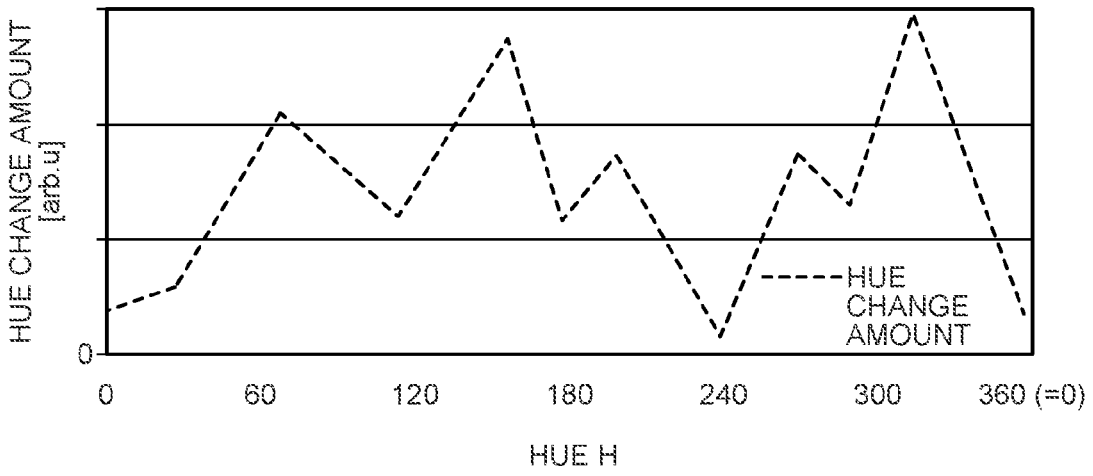
FIG. 11 is a diagram for illustrating a look-up table indicating a relation between an original hue prior to conversion and a hue change amount defined to fall within an allowable range of a change in the hue according to the first embodiment.

The hue conversion step will be described with reference to FIGS. 10 and 11. FIG. 10 is a conceptual diagram of hue conversion in the HSV color space according to the first embodiment. FIG. 11 is a diagram for illustrating a look-up table indicating a relation between an original hue prior to conversion and a hue change amount defined to fall within an allowable range of a change in the hue according to the first embodiment.

In the hue conversion step, the converting unit 10 according to the first embodiment shifts the hue H of the original color such that the luminance of the second color information resulting from the color conversion is higher than that of the first color information prior to the color conversion. Specifically, the converting unit 10 shifts the hue H by equal to or smaller than hue change amounts PRG, PGB, and PRB illustrated in FIG. 10 within a predetermined range defined to be an allowable range of a change in the hue.

As illustrated in FIGS. 10 and 11, a change in the hue H is easily recognized in a region LRL including a region LR 100 at an angle of 0□ and the region at an angle of 0□ to 30□ and a region near a region LB 100 at an angle of 240□. In these regions, the amount of conversion in the hue H should be set lower. By contrast, by shifting the hue H closer to green (closer to a region LG 100) by the hue change amount PRG in the region beyond an angle of 30□ and below the region LG 100, the light use efficiency is improved. Also by shifting the hue H closer to green (closer to the region LG 100) by the hue change amount PGB in the region beyond the region LG 100 and below the region LB 100, the light use efficiency is improved. Also by shifting the hue H closer to red (closer to the region LR 100) by the hue change amount PRB in the region beyond the region LB 100 and below the region LR 100, the light use efficiency is improved. This is because the luminance is higher in order of green, red, and blue. By performing conversion such that the hue of the second color information resulting from the color conversion has higher luminance than that of the hue of the first color information prior to the color conversion, the light use efficiency is improved in the entire image display unit 30. The converting unit 10 according to the first embodiment stores therein the information on the look-up table of the hue change amount with respect to the hue H illustrated in FIG. 11. Based on the look-up table of the hue change amount with respect to the hue H, the converting unit 10 calculates the hue change amounts PRG, PGB, and PRB.

Figure 12:
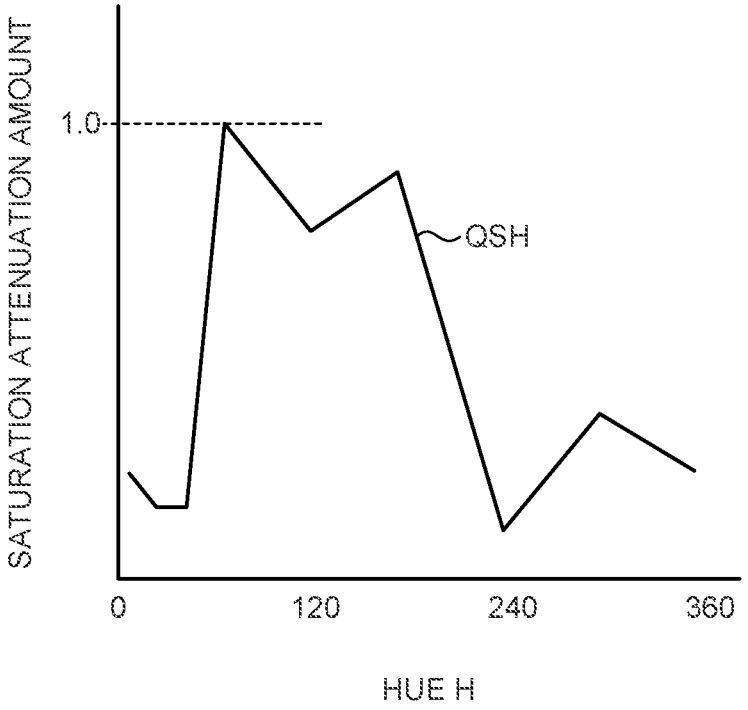
FIG. 12 is a diagram for illustrating a look-up table indicating a relation between the hue and a saturation attenuation amount within a predetermined range defined to be an allowable range of a change in the saturation according to the present embodiment.
Figure 13:
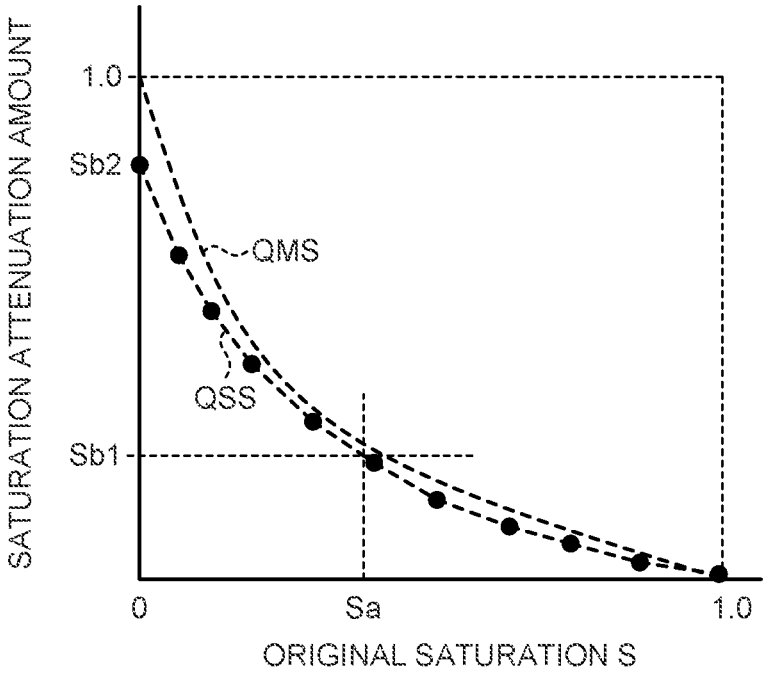
FIG. 13 is a diagram for illustrating a look-up table indicating a relation between original saturation prior to conversion and the saturation attenuation amount within the predetermined range defined to be the allowable range of a change in the saturation according to the present embodiment.
Figure 14:
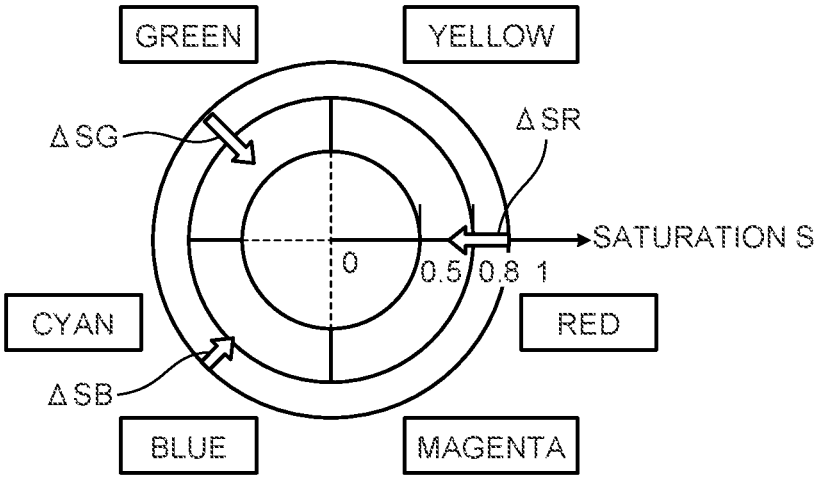
FIG. 14 is a conceptual diagram of the saturation attenuation amount in the HSV color space according to the present embodiment.

The saturation conversion step will be described with reference to FIGS. 12 to 14. FIG. 12 is a diagram for illustrating a look-up table indicating a relation between the hue and a saturation attenuation amount within a predetermined range defined to be an allowable range of a change in the saturation according to the present embodiment. FIG. 13 is a diagram for illustrating a look-up table indicating a relation between original saturation prior to conversion and the saturation attenuation amount within the predetermined range defined to be the allowable range of a change in the saturation according to the present embodiment. FIG. 14 is a conceptual diagram of the saturation attenuation amount in the HSV color space according to the present embodiment.

In the saturation conversion step, the converting unit 10 according to the first embodiment performs processing for attenuating the saturation of the original color (original saturation S) within a predetermined range defined to be an allowable range of a change in the saturation such that the amount of the white component in the second color information resulting from the color conversion is larger than the white component prior to the color conversion.

As illustrated in FIG. 12, the saturation attenuation amount within the predetermined range defined to be an allowable range of a change in the saturation varies depending on the hue H. The look-up table illustrated in FIG. 12 is first saturation conversion information indicating a gain value QSH with the saturation attenuation amount for each hue H plotted on the ordinate.

As illustrated in FIG. 12, if the hue H is one of the red component and the blue component, the saturation attenuation amount within the predetermined range defined to be an allowable range of a change in the saturation is small. The red component corresponds to the region including an angle of 0□, and the blue component corresponds to the region including an angle of 240□. Therefore, the saturation attenuation amount by which the converting unit 10 can change the saturation is small.

The first sub-pixel 49R, the second sub-pixel 49G, the third sub-pixel 49B, and the fourth sub-pixel 49W display the respective color components based on an output from the signal processing unit 200. The fourth sub-pixel 49W has higher light transmittance than that of the first sub-pixel 49R, the second sub-pixel 49G, and the third sub-pixel 49B. To improve the light use efficiency in the entire image display unit 30, the hue of the second color information resulting from the color conversion is preferably closer to a color having a larger amount of white component than that of the hue of the first color information prior to the color conversion.

As illustrated in FIG. 13, the saturation attenuation amount defined to fall within an allowable range of a change in the saturation varies depending on the original saturation S. In the look-up table illustrated in FIG. 13, a curve of the lower limit of the saturation attenuation amount at which a change in the saturation is recognized is plotted as a recognition characteristic curve QMS with respect to the original saturation S prior to the conversion performed by the converting unit 10. The converting unit 10 stores therein an approximate curve QSS plotted below the recognition characteristic curve QMS with respect to the original saturation S as first saturation conversion information. The approximate curve QSS, for example, is stored in a manner falling below all the recognition characteristic curves QMS for the primary color of the red component, the primary color of the green component, and the primary color of the blue component in the hue H. For example, when the original saturation S is saturation Sa, the saturation attenuation amount is Sb1; whereas when the original saturation is 0, the saturation attenuation amount is Sb2. The approximate curve QSS may be stored as a function or a look-up table. Alternatively, the approximate curve QSS may be sequentially calculated so as to fall below the recognition characteristic curve QMS.

As illustrated in FIG. 14, the converting unit 10 according to the first embodiment calculates a gain value of the saturation attenuation amount such that it corresponds to any one of saturation attenuation amounts □SR, □SG, and □SB based on the information of the look-up tables illustrated in FIGS. 12 and 13. The converting unit 10 then multiplies the first color information corresponding to the input value in the HSV color space by the gain value, thereby performing the saturation conversion step. The converting unit 10, for example, uses a gain value obtained by multiplying the look-up tables illustrated in FIGS. 12 and 13. This operation can provide a more accurate gain value for each hue. Alternatively, the converting unit 10, for example, uses a gain value obtained by adding up the look-up tables illustrated in FIGS. 12 and 13. This operation can reduce the arithmetic load in the conversion. As described above, the fourth sub-pixel 49W has higher light transmittance than that of the first sub-pixel 49R, the second sub-pixel 49G, and the third sub-pixel 49B. Thus, the light use efficiency when the additional color component (W) is expressed by the fourth sub-pixel 49W is higher than that when the additional color component (W) is expressed by the first sub-pixel 49R, the second sub-pixel 49G, and the third sub-pixel 49B. To improve the light use efficiency in the entire image display unit 30, the hue of the second color information resulting from the color conversion is preferably closer to a color having a larger amount of white component than that of the hue of the first color information prior to the color conversion.

The converting unit 10 may perform one or both of the hue conversion step and the saturation conversion step at the color conversion step (Step S15). When performing both of the hue conversion step and the saturation conversion step, the converting unit 10 may perform either of them first or perform both of them simultaneously.

In the hue conversion step and the saturation conversion step at the color conversion step (Step S15), the converting unit 10 performs processing such that the luminance of the second color information resulting from the color conversion is higher than that of the first color information prior to the color conversion. Let us assume a case where the first input signal SRGB1 corresponding to the first color information is converted into the second input signal SRGB2 corresponding to the second color information at the color conversion step (Step S15) as illustrated in FIG. 7, for example. In this case, the converting unit 10 calculates one or both of the hue change amount and the saturation attenuation amount so as to increase the G component based on the color conversion ratio RCC. This operation increases the amount of the white component made of the red component, the green component, and the blue component, which are simple color components, of the same amount.

As illustrated in FIG. 6, the converting unit 10 according to the first embodiment performs a luminance adjustment step for performing an arithmetic operation to reduce the saturation so as not to make the brightness of the second color information resulting from the color conversion different from that of the first color information prior to the color conversion (Step S16). The converting unit 10 then outputs the second input signal SRGB2 generated at the luminance adjustment step to the fourth sub-pixel signal processing unit 20. Because the color conversion step (Step S15) makes the luminance of the second color information resulting from the color conversion higher than that of the first color information prior to the color conversion, the converting unit 10 performs the luminance adjustment step (Step S16), thereby reducing the saturation of the second color information. Specifically, as illustrated in FIG. 7, the data values of the respective colors in the second input signal SRGB2 are reduced. As illustrated in FIG. 7, for example, the second color information appears to be brighter than the first color information after the color conversion step (Step S15). The converting unit 10 adjusts the luminance so as not to make the brightness of the second color information different from that of the first color information.

Subsequently, the fourth sub-pixel signal processing unit 20 performs an RGBW signal processing step (Step S17) for converting the second input signal SRGB2 into an extended value in the HSV color space extended by the first color (R), the second color (G), the third color (B), and the fourth color (W). The RGBW signal processing step generates data of the W component corresponding to the additional color component displayed by the fourth sub-pixel 49W. Furthermore, the RGBW signal processing step reduces the data value of the R component displayed by the first sub-pixel 49R, the data value of the G component displayed by the second sub-pixel 49G, and the data value of the B component displayed by the third sub-pixel 49B.

The fourth sub-pixel signal processing unit 20 performs a data extension step (Step S18) for extending the data of the respective colors and outputs an output signal SRGBW to the image-display-panel drive circuit 40. The fourth sub-pixel signal processing unit 20 then performs a light source output reduction step (Step S19) for controlling the light-source-device control circuit 60 so as to reduce the amount of light output from the light source device 50 to the image display unit 30 by the amount of extended data. The light source output reduction step makes it possible to reduce the power consumption in the light source device 50 by an amount of reduction in the amount of light output from the light source device 50 to the image display unit 30.

Figure 15:
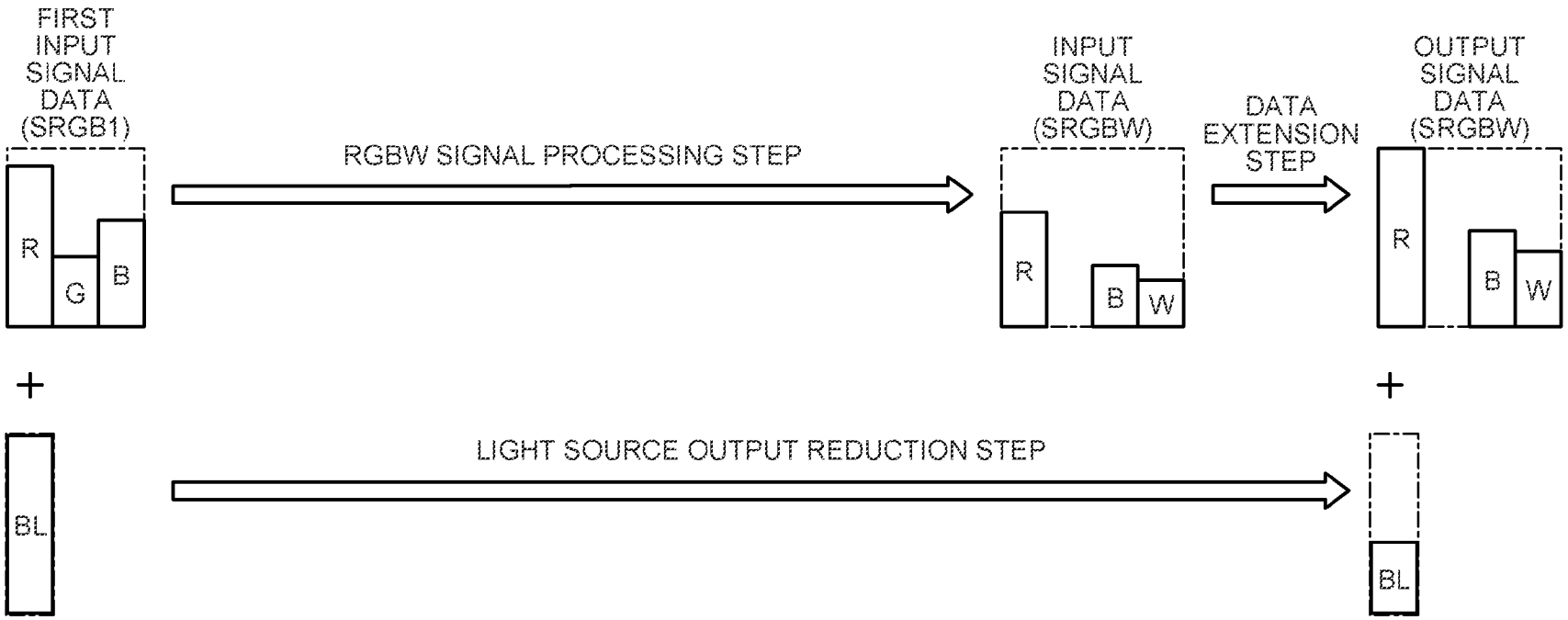
FIG.15 RELATED ART
FIG. 15 is a schematic diagram for illustrating exemplary color conversion according to a comparative example.

FIG. 15 is a schematic diagram for illustrating exemplary color conversion according to a comparative example. As illustrated in FIG. 15, the exemplary color conversion according to the comparative example does not perform the color conversion step (Step S15) or the luminance adjustment step (Step S16) illustrated in FIG. 6. The exemplary color conversion can reduce the amount of light output from the light source device 50 to the image display unit 30 by the amount of extension of data at the data extension step, thereby reducing the power consumption in the light source device 50. In the exemplary color conversion, however, the data value of the W component generated in the RGBW signal processing step is smaller. As a result, the amounts of reduction in the data values of the other color components are made smaller, and the degree of data extension at the data extension step is made smaller. Thus, the degree of reduction in the output from the light source device 50 in the light source output reduction step is made smaller than that in the exemplary color conversion according to the first embodiment. As a result, the effect of reducing the power consumption in the light source device 50 is made smaller than that in the exemplary color conversion according to the first embodiment. Compared with the processing according to the comparative example, the color conversion according to the first embodiment can increase the additional color component, that is, the W component displayed by the fourth sub-pixel 49W, and reduce the output from the light source device 50. Thus, the color conversion according to the first embodiment can increase the effect of reducing the power consumption in the light source device 50.

As described above, the display device 100 and the color conversion method according to the first embodiment perform color conversion on the first color information composed of the three primary color components of the R component, the G component, and the B component derived based on an input video signal. Specifically, the display device 100 and the color conversion method perform color conversion so as to increase the luminance within an allowance range of a change in at least one of the hue and the saturation, thereby generating the second color information. This operation can improve the light use efficiency in the entire image display unit 30, and therefore can reduce the amount of light output from the light source device 50 to the image display unit 30 by an increase in the luminance caused by the color conversion. Thus, the first embodiment can reduce the power consumption in the light source device 50 by an amount of reduction in the amount of light output from the light source device 50 to the image display unit 30.

The image display unit 30 includes the pixels 48 arranged in a matrix. The pixels 48 each include the first sub-pixel 49R that displays the R component, the second sub-pixel 49G that displays the G component, the third sub-pixel 49B that displays the B component, and the fourth sub-pixel 49W that displays the additional color component. The fourth sub-pixel 49W is different from the first sub-pixel 49R, the second sub-pixel 49G, and the third sub-pixel 49B, and displays the additional color component that can be expressed by the first sub-pixel 49R, the second sub-pixel 49G, and the third sub-pixel 49B. Light use efficiency when the additional color component is expressed by the fourth sub-pixel 49W is higher than that when the additional color component is expressed by the first sub-pixel 49R, the second sub-pixel 49G, and the third sub-pixel 49B. To perform display on the image display unit 30, the first embodiment converts the second color information into the third color information including the R component, the G component, the B component, and the additional color component and performs data extension, thereby outputting the output signal SRGBW. As a result, the first embodiment can further reduce the amount of light output from the light source device 50 to the image display unit 30 by the amount of extension of data. Thus, the first embodiment can further reduce the power consumption in the light source device 50 by an amount of reduction in the amount of light output from the light source device 50 to the image display unit 30.

To generate the second color information, a predictive value of power consumption is calculated from the first color information for performing display on a predetermined pixel based on the first input signal SRGB1. The color conversion is performed at the color conversion ratio RCC associated with the predictive value of power consumption. Thus, the first embodiment can display the input video signal while preventing the predictive value from exceeding the power limit value.

The luminance adjustment is performed such that the saturation of the second color information is attenuated compared with the original saturation S so as not to make the brightness of the second color information different from that of the first color information. With this operation, deterioration in the image is hardly recognized by humans. As a result, the display device 100 can reduce the power consumption while suppressing deterioration (degradation) in the display quality as a whole.

The converting unit 10 reduces the saturation with the saturation attenuation amount varying depending on the hue of the first color information. Because this operation makes the saturation attenuation amount smaller in the hue where humans notice a difference, deterioration in the image is hardly recognized by humans. As a result, the display device 100 can reduce the power consumption while suppressing deterioration (degradation) in the display quality as a whole.

The converting unit 10 performs an arithmetic operation for hue conversion such that the amount of light transmitted through the first sub-pixel 49R, the second sub-pixel 49G, and the third sub-pixel 49B when the second color information is used to display is smaller than that when the first color information is used to display. The converting unit 10 preferably performs the arithmetic operation for hue conversion based on a value obtained by subtracting the color component having the lowest luminance from the color component having the highest luminance out of the R component, the G component, and the B component included in the first color information. This operation maintains the balance of the color. Let us assume a case where an image analysis on all the pixels shows that the chromaticity deviates to the G component, for example. In this case, the converting unit 10 performs hue conversion such that the amount of light transmitted through the first sub-pixel 49R, the second sub-pixel 49G, and the third sub-pixel 49B when the second color information is used to display is smaller than that when the first color information is used to display compared with the case where the chromaticity does not deviate to the G component. As a result, the display device 100 can reduce the power consumption while suppressing deterioration (degradation) in the display quality as a whole.

The present embodiment provides the display device and the color conversion method that can improve the light use efficiency in the liquid crystal display panel.

Second Embodiment

Figure 16:
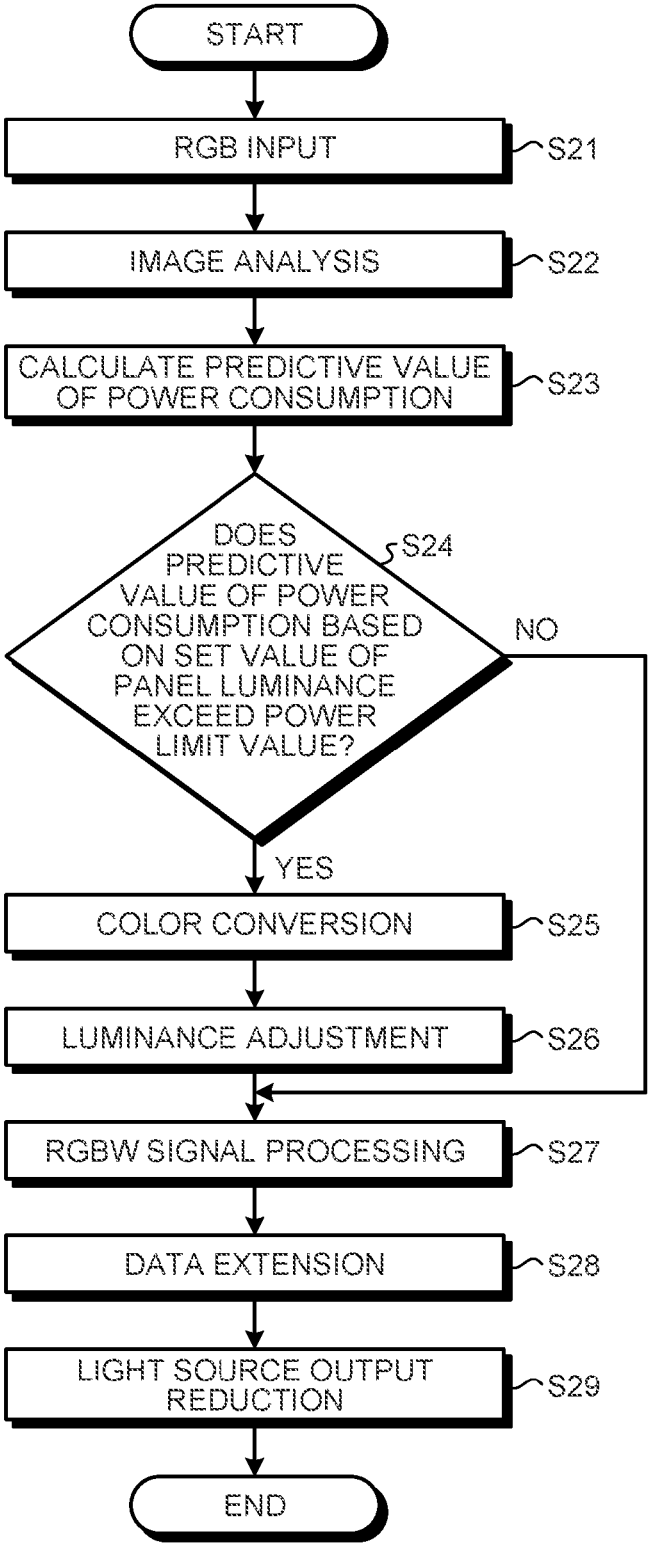
FIG. 16 is a flowchart for illustrating a color conversion method according to a second embodiment.
Figure 17:
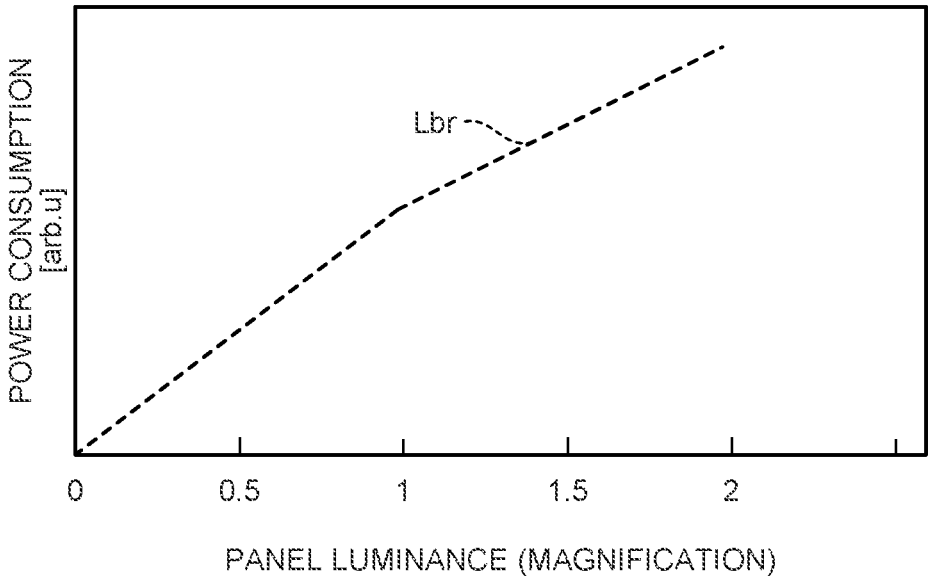
FIG. 17 is a diagram for illustrating a look-up table indicating a correlation of the predictive value of power consumption with respect to panel luminance according to the second embodiment.
Figure 18:
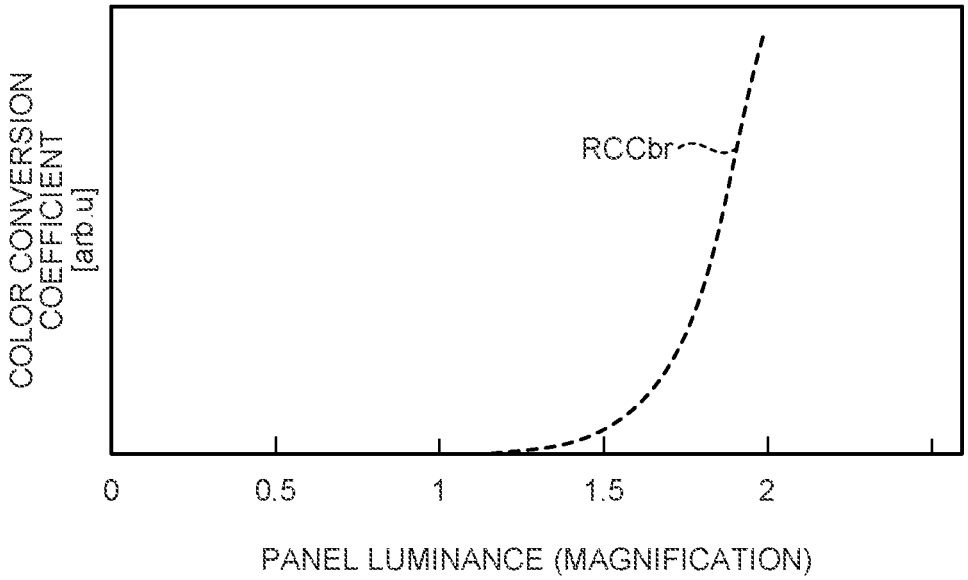
FIG. 18 is a diagram for illustrating a look-up table indicating a color conversion coefficient with respect to the panel luminance according to the second embodiment.
Figure 19:
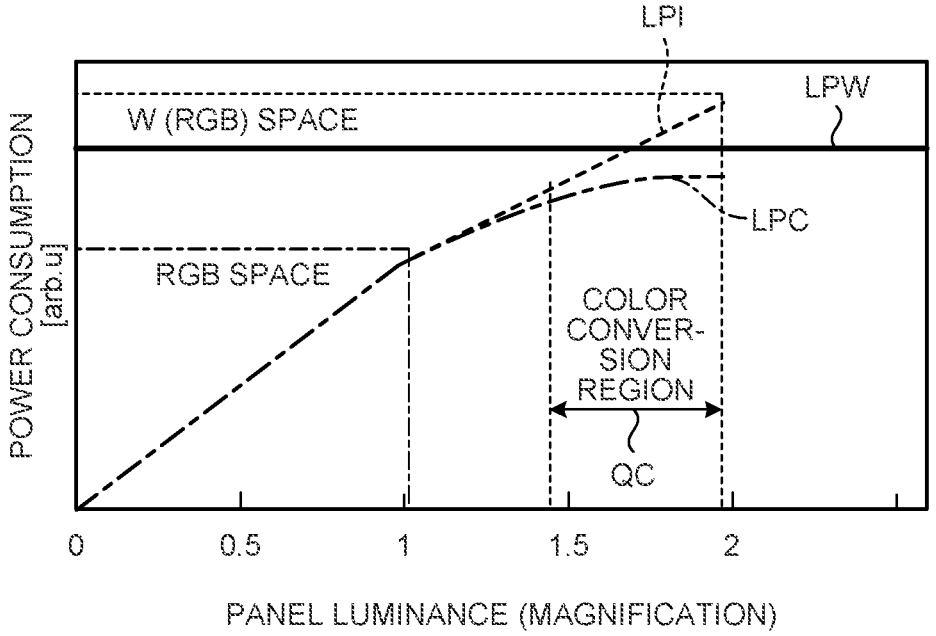
FIG. 19 is a diagram for illustrating a state where the predictive value of power consumption based on a set value of the panel luminance exceeds a power limit value according to the second embodiment.

FIG. 16 is a flowchart for illustrating a color conversion method according to a second embodiment. FIG. 17 is a diagram for illustrating a look-up table indicating the color conversion ratio associated with respect to the predictive value of power consumption with respect to panel luminance according to the second embodiment. FIG. 18 is a diagram for illustrating a look-up table indicating a color conversion coefficient with respect to the panel luminance according to the second embodiment. FIG. 19 is a diagram for illustrating a state where the predictive value of power consumption based on a set value of the panel luminance exceeds the power limit value according to the second embodiment. Components identical to those described in the embodiment above are denoted by the same reference numerals, and overlapping description thereof will be omitted.

Similarly to the display device 100 according to the first embodiment, the display device 100 according to the second embodiment can broaden the dynamic range of brightness in the HSV color space as illustrated in FIG. 4 by including the fourth sub-pixel 49W that outputs the fourth color (white) in the pixel 48. A set value of the panel luminance is set and stored as the brightness of the image display unit 30 based on an input performed by an operator who operates the display device 100. Assume the highest brightness expressed by the cylindrical HSV color space displayable by the first sub-pixel 49R, the second sub-pixel 49G, and the third sub-pixel 49B corresponds to a magnification of the panel luminance of 1, for example, the correlation between the power consumption and the panel luminance is expressed by a correlation curve Lbr illustrated in FIG. 17. In FIG. 17, the abscissa indicates the magnification of the panel luminance, whereas the ordinate indicates the predictive value of power consumption per frame of display image data in an input video signal according to the second embodiment. Let us assume a case where a magnification of the panel luminance exceeding the highest brightness displayable by the first sub-pixel 49R, the second sub-pixel 49G, and the third sub-pixel 49B is set (a case where the magnification of the panel luminance is larger than 1). In this case, the correlation curve Lbr shows that the power consumption may possibly increase to exceed the threshold of the power limit value of the display device 100 depending on the display image data in the input video signal.

To address this, the display device 100 according to the second embodiment performs the color conversion method according to the second embodiment illustrated in FIG. 16. As illustrated in FIG. 16, the converting unit 10 receives the first color information as the first input signal SRGB1, the first color information being derived based on an input video signal and used to perform display on a predetermined pixel (Step S21). The first color information is subjected to gamma conversion as needed, and a value in the RGB coordinate system is converted into an input value in the HSV color space.

The converting unit 10 performs an image analysis on the input video signal at the image analysis step (Step S22). Alternatively, the converting unit 10 acquires image analysis information on the input video signal calculated by other processing at the image analysis step (Step S22).

Based on the result of the image analysis performed on the input video signal, the converting unit 10 performs the power consumption prediction step for calculating a predictive value of power consumption (Step S23). The converting unit 10 derives the power consumption by calculating the power consumption per frame from the first color information for performing display on the predetermined pixel based on the first input signal SRGB1 received at Step S21. The converting unit 10 then multiples the power consumption by the correlation indicated by the look-up table in FIG. 17, thereby calculating a predictive value of power consumption based on a set value of the panel luminance.

As illustrated in FIG. 16, if the predictive value of power consumption based on the set value of the panel luminance does not exceed the threshold of the power limit value (No at Step S24), the converting unit 10 performs processing at Step S27.

As illustrated in FIG. 16, if the predictive value of power consumption exceeds the threshold of the power limit value (Yes at Step S24), the converting unit 10 performs processing at Step S25. The converting unit 10 stores therein in advance the look-up table indicating a correlation curve RCCbr of the color conversion coefficient with respect to the magnification of the panel luminance as the set value of the panel luminance illustrated in FIG. 18.

The converting unit 10 according to the second embodiment calculates the color conversion ratio RCC based on the predictive value of power consumption calculated at the power consumption prediction step (Step S23) and the information on the color conversion ratio with respect to the predictive value of power consumption illustrated in FIG. 9. The converting unit 10 according to the second embodiment then multiples the calculated color conversion ratio RCC by the color conversion coefficient with respect to the magnification of the panel luminance as the set value of the panel luminance illustrated in FIG. 18, thereby correcting the color conversion ratio RCC. Thus, the converting unit 10 according to the second embodiment can calculate the color conversion ratio RCC based on the power consumption fluctuating depending on the display image data SG in the input video signal per frame.

The converting unit 10 according to the second embodiment performs at least one of the hue conversion step and the saturation conversion step at the color conversion step (Step S25). Because the processing from Step S25 to Step S29 is the same as that from Step S15 to Step S19 according to the first embodiment, description thereof is omitted.

As described above, the converting unit 10 calculates the predictive value of power consumption based on the received set value of the panel luminance. With this operation, the converting unit 10 can perform color conversion on the first color information received as the first input signal at the color conversion ratio RCC associated with the predictive value of power consumption based on the set value of the panel luminance. Let us assume a case where a magnification of the panel luminance exceeding the highest brightness in the RGB space displayable by the first sub-pixel 49R, the second sub-pixel 49G, and the third sub-pixel 49B is set (a case where the magnification of the panel luminance is larger than 1). In this case, power consumption LPI may possibly increase to exceed a threshold LPW of the power limit value of the display device 100 depending on the display image data in the input video signal as illustrated in FIG. 19. The converting unit 10, however, can reduce the power consumption to power consumption LPC in a color conversion region QC. As a result, the power consumption LPC is lower than the threshold LPW of the power limit value in the color conversion region QC.

In a case where an input image is a target for power limitation on the predictive value of power consumption of pixels in one frame, the converting unit 10 increases the color conversion ratio RCC in the color conversion. With this configuration, the converting unit 10 can selectively perform the color conversion such that an input image having a high luminance setting and likely to be a target for power limitation is subjected to the color conversion to reduce the power consumption and that the original settings of the other input images are maintained.

The present embodiment provides the display device and the color conversion method that can improve the light use efficiency in the liquid crystal display panel.

Third Embodiment

Figure 20:
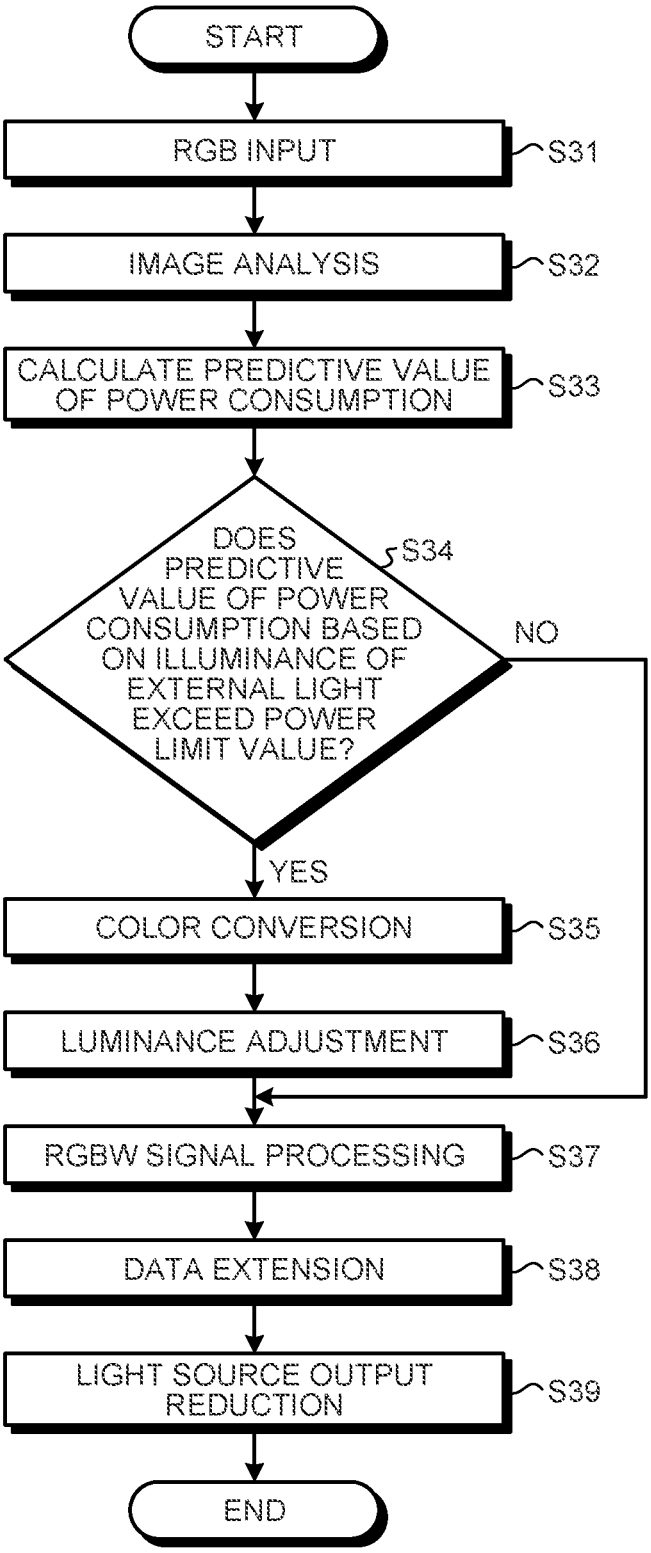
FIG. 20 is a flowchart for illustrating a color conversion method according to a third embodiment.
Figure 21:
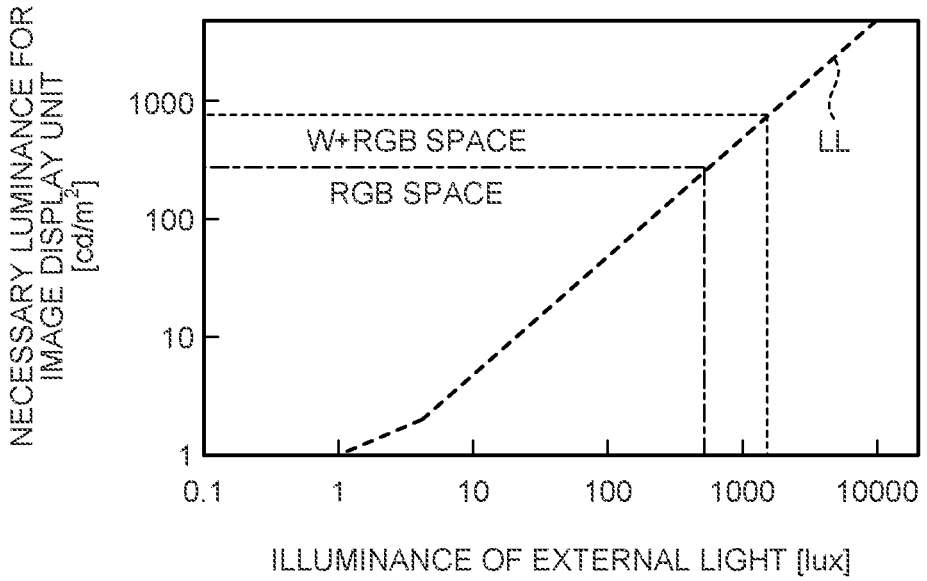
FIG. 21 is a diagram for illustrating a look-up table indicating necessary luminance for a display with respect to the illuminance of external light according to the third embodiment.
Figure 22:
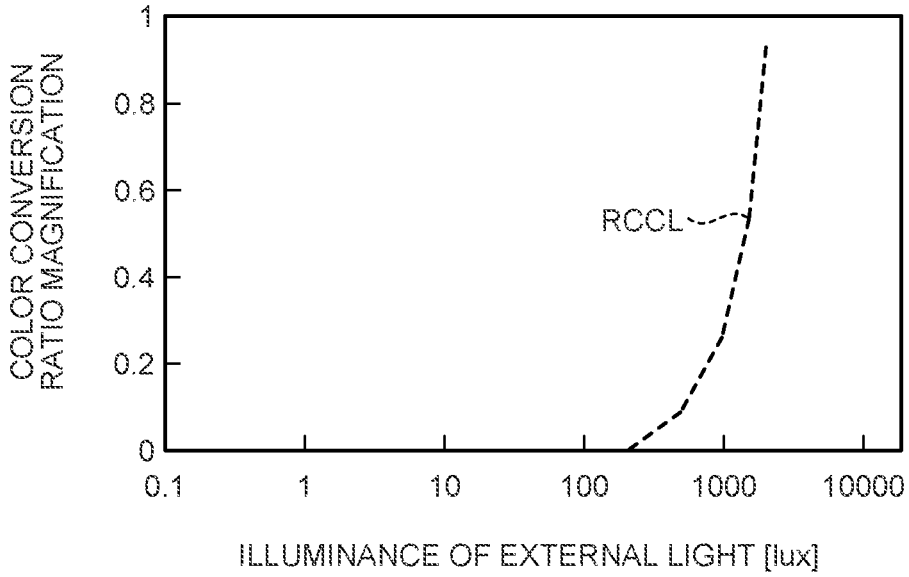
FIG. 22 is a diagram for illustrating a look-up table indicating the color conversion ratio with respect to the illuminance of external light according to the third embodiment.

FIG. 20 is a flowchart for illustrating a color conversion method according to a third embodiment. FIG. 21 is a diagram for illustrating a look-up table indicating necessary luminance for a display with respect to the illuminance of external light according to the third embodiment. FIG. 22 is a diagram for illustrating a look-up table indicating the color conversion ratio with respect to the illuminance of external light according to the third embodiment. Components identical to those described in the embodiments above are denoted by the same reference numerals, and overlapping description thereof will be omitted.

Similarly to the display device 100 according to the first embodiment, the display device 100 according to the third embodiment can broaden the dynamic range of brightness in the HSV color space as illustrated in FIG. 4 by including the fourth sub-pixel 49W that outputs the fourth color (white) in the pixel 48. When the illuminance of external light is high, the display device 100 may possibly increase the brightness of the image display unit 30, thereby improving the visibility. The converting unit 10 of the display device 100 according to the third embodiment, for example, stores therein correlation information LL indicating necessary luminance for the image display unit 30 based on the illuminance of external light illustrated in FIG. 21. Let us assume a case where the brightness of the image display unit 30 is increased without any limitation based on the illuminance of external light to exceed the highest brightness expressed in the RGB space displayable by the first sub-pixel 49R, the second sub-pixel 49G, and the third sub-pixel 49B, and display is performed in the W□RGB space displayable by the first sub-pixel 49R, the second sub-pixel 49G, the third sub-pixel 49B, and the fourth sub-pixel 49W. In this case, the power consumption may possibly increase to exceed the threshold of the power limit value of the display device 100 depending on the display image data in the input video signal.

To address this, the display device 100 according to the third embodiment performs the color conversion method according to the third embodiment illustrated in FIG. 20. The converting unit 10 according to the third embodiment receives the first color information as the first input signal SRGB1, the first color information being derived based on an input video signal and used to perform display on a predetermined pixel (Step S31). The first color information is subjected to gamma conversion as needed, and a value in the RGB coordinate system is converted into an input value in the HSV color space.

The converting unit 10 performs an image analysis on the input video signal at the image analysis step (Step S32). Alternatively, the converting unit 10 acquires image analysis information on the input video signal calculated by other processing at the image analysis step (Step S32).

Based on the result of the image analysis performed on the input video signal, the converting unit 10 performs the power consumption prediction step for calculating a predictive value of power consumption (Step S33). The converting unit 10 derives the power consumption by calculating the power consumption per frame from the first color information for performing display on the predetermined pixel based on the first input signal SRGB1 received at Step S31. The converting unit 10 then adds the correlation indicated by the look-up table in FIG. 21 to the power consumption, thereby calculating a predictive value of power consumption based on the illuminance of external light.

As illustrated in FIG. 20, if the predictive value of power consumption based on the illuminance of external light does not exceed a threshold of the power limit value (No at Step S34), the converting unit 10 performs processing at Step S37.

As illustrated in FIG. 20, if the predictive value of power consumption exceeds the threshold of the power limit value (Yes at Step S34), the converting unit 10 performs processing at Step S35. The converting unit 10 stores therein in advance the look-up table indicating a correlation curve RCCL of the color conversion ratio magnification with respect to the illuminance of external light as the set value of the panel luminance illustrated in FIG. 22.

The converting unit 10 according to the third embodiment calculates the color conversion ratio RCCL based on the information on the color conversion ratio with respect to the illuminance of external light illustrated in FIG. 22. As a result, the converting unit 10 according to the third embodiment can calculate the weighted color conversion ratio RCCL besides the color conversion ratio with respect to the power consumption fluctuating depending on the display image data SG in the input video signal per frame. Thus, the converting unit 10 can calculate the predictive value of power consumption in the panel luminance setting based on the illuminance of external light.

The converting unit 10 according to the third embodiment performs at least one of the hue conversion step and the saturation conversion step at the color conversion step (Step S35). Because the processing from Step S35 to Step S39 is the same as that from Step S15 to Step S19 according to the first embodiment, description thereof is omitted.

As described above, the converting unit 10 calculates the predictive value of power consumption in the panel luminance setting based on the illuminance of external light. With this operation, the converting unit 10 can perform color conversion on the first color information received as the first input signal at the color conversion ratio associated with the predictive value of power consumption based on the illuminance of external light. Let us assume a case where the display device 100 sets, when the illuminance of external light is high, the panel luminance to a value exceeding the highest brightness in the RGB space displayable by the first sub-pixel 49R, the second sub-pixel 49G, and the third sub-pixel 49B. Even in this case, the converting unit 10 can prevent the power consumption from exceeding the threshold of the power limit value of the display device 100 depending on the display image data in the input video signal. As a result, the display device 100 according to the third embodiment can secure the visibility in an environment having high illuminance of external light.

As illustrated in FIG. 4, for example, the brightness V is hardly increased in regions closer to primary colors and having high saturation. To address this, the converting unit 10 according to the present embodiment reduces the saturation and performs display in the W+RGB space that can be displayed by lighting up the fourth sub-pixel 49W with brightness exceeding the highest brightness expressed in the RGB space, thereby increasing the brightness V.

The present embodiment provides the display device and the color conversion method that can improve the light use efficiency in the liquid crystal display panel.

Fourth Embodiment

Figure 23:
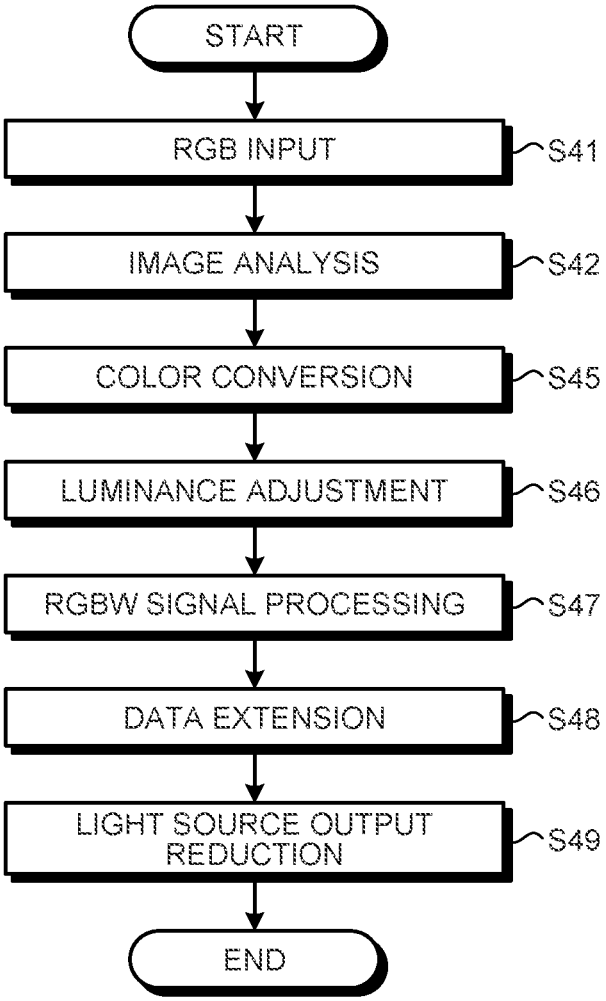
FIG. 23 is a flowchart for illustrating a color conversion method according to a fourth embodiment.

FIG. 23 is a flowchart for illustrating a color conversion method according to a fourth embodiment. Components identical to those described in the embodiments above are denoted by the same reference numerals, and overlapping description thereof will be omitted.

Similarly to the display device 100 according to the first embodiment, the display device 100 according to the fourth embodiment can broaden the dynamic range of brightness in the HSV color space as illustrated in FIG. 4 by including the fourth sub-pixel 49W that outputs the fourth color (white) in the pixel 48. The first to the third embodiments perform at least one of the hue conversion step and the saturation conversion step when the power consumption exceeds the threshold of the power limit value of the display device 100, for example. By contrast, the fourth embodiment uniformly performs color conversion independently of the power consumption of the display device 100. Thus, the fourth embodiment can improve the light use efficiency, thereby reducing the power consumption in the light source device 50 independently of the luminance of the input video signal, the set value of the panel luminance, or the illuminance of external light.

The display device 100 according to the fourth embodiment performs the color conversion method according to the fourth embodiment illustrated in FIG. 23. The converting unit 10 according to the fourth embodiment receives the first color information as the first input signal SRGB1, the first color information being derived based on an input video signal and used to perform display on a predetermined pixel (Step S41). The first color information is subjected to gamma conversion as needed, and a value in the RGB coordinate system is converted into an input value in the HSV color space.

The converting unit 10 performs an image analysis on the input video signal at the image analysis step (Step S42). Alternatively, the converting unit 10 acquires image analysis information on the input video signal calculated by other processing at the image analysis step (Step S42).

The converting unit 10 according to the fourth embodiment performs at least one of the hue conversion step and the saturation conversion step at the color conversion step (Step S45). Because the processing from Step S45 to Step S49 is the same as that from Step S15 to Step S19 according to the first embodiment, description thereof is omitted.

As described above, the converting unit 10 uniformly performs color conversion independently of the power consumption of the display device 100. Thus, the display device 100 according to the fourth embodiment can improve the light use efficiency, thereby reducing the power consumption in the light source device 50 independently of the luminance of the input video signal, the set value of the panel luminance, or the illuminance of external light.

The present embodiment provides the display device and the color conversion method that can improve the light use efficiency in the liquid crystal display panel.

Fifth Embodiment

Figure 24:
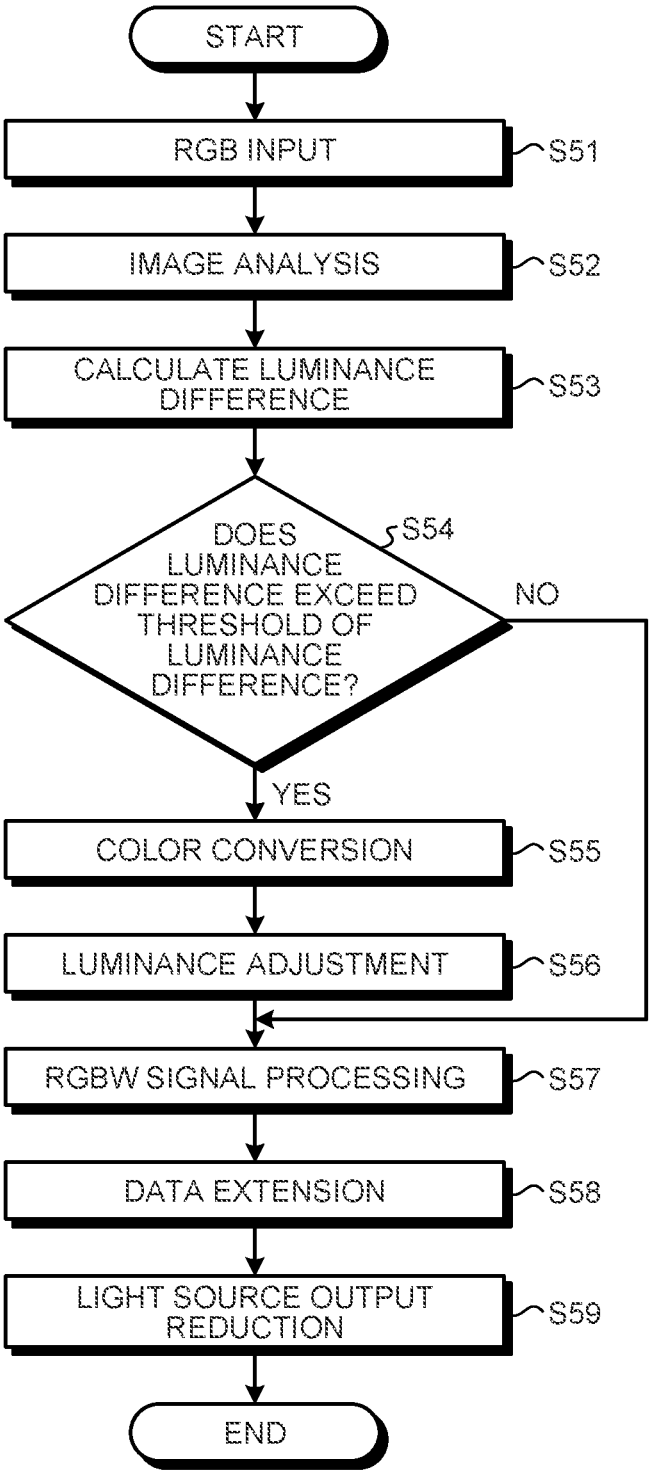
FIG. 24 is a flowchart for illustrating a color conversion method according to a fifth embodiment.

FIG. 24 is a flowchart for illustrating a color conversion method according to a fifth embodiment. Components identical to those described in the embodiments above are denoted by the same reference numerals, and overlapping description thereof will be omitted.

Similarly to the display device 100 according to the first embodiment, the display device 100 according to the fifth embodiment can broaden the dynamic range of brightness in the HSV color space as illustrated in FIG. 4 by including the fourth sub-pixel 49W that outputs the fourth color (white) in the pixel 48. Let us assume a case where one frame of the input video signal includes both image data having higher saturation and image data having lower saturation. In this case, there is less room for data extension of the image data having higher saturation, whereas there is more room for data extension of the image data having lower saturation. Data extension without performing color conversion tends to make the luminance of the image data having lower saturation higher than that of the image data having higher saturation, thereby increasing the luminance ratio. To address this, in the present embodiment, color conversion is performed when the luminance difference between an area having lower saturation and an area having higher saturation in the first color information derived based on the input video signal exceeds a threshold of the luminance difference. This operation increases the room for data extension of the image data having higher saturation. Thus, the present embodiment can improve the light use efficiency, thereby reducing the power consumption in the light source device 50 without significantly changing the luminance ratio before and after the data extension.

The display device 100 according to the fifth embodiment performs the color conversion method according to the fifth embodiment illustrated in FIG. 24. The converting unit 10 according to the fifth embodiment receives the first color information as the first input signal SRGB1, the first color information being derived based on an input video signal and used to perform display on a predetermined pixel (Step S51). The first color information is subjected to gamma conversion as needed, and a value in the RGB coordinate system is converted into an input value in the HSV color space.

The converting unit 10 performs an image analysis on the input video signal at the image analysis step (Step S52). Alternatively, the converting unit 10 acquires image analysis information on the input video signal calculated by other processing at the image analysis step (Step S52).

Based on the result of the image analysis performed on the input video signal, the converting unit 10 performs a luminance difference calculation step (Step S53). In the luminance difference calculation step, the converting unit 10 calculates a luminance difference with respect to the image data having the lowest saturation out of the image data included in the first color information constituting one frame of the input video signal.

The converting unit 10 according to the fifth embodiment stores therein a threshold of the luminance difference as a set value in advance.

The converting unit 10 determines whether the luminance difference calculated at Step S53 exceeds the threshold of the luminance difference (Step S54). If the luminance difference calculated at Step S53 does not exceed the threshold of the luminance difference (No at Step S54), the converting unit 10 performs processing at Step S57.

By contrast, if the luminance difference calculated at Step S53 exceeds the threshold of the luminance difference (Yes at Step S54), the converting unit 10 performs processing at Step S55.

The converting unit 10 according to the fifth embodiment performs at least one of the hue conversion step and the saturation conversion step at the color conversion step (Step S55). Because the processing from Step S55 to Step S59 is the same as that from Step S15 to Step S19 according to the first embodiment, description thereof is omitted.

At a data extension step (Step S58), a mutual effect between yellow and white may possibly make yellow dull as a result of the data extension. This phenomenon is called simultaneous contrast. To address this, the converting unit 10 performs the color conversion step (Step S55) only on an area where the luminance difference with respect to the image data having the lowest saturation out of the image data included in the first color information constituting one frame of the input video signal exceeds the threshold of the luminance difference. Thus, the converting unit 10 can prevent the simultaneous contrast.

As described above, the converting unit 10 performs color conversion when the luminance difference between an area having lower saturation and an area having higher saturation in the first color information derived based on the input video signal exceeds the threshold of the luminance difference. With this operation, the converting unit 10 increases the room for data extension of the image data having higher saturation. Thus, the converting unit 10 can prevent the simultaneous contrast without significantly changing the luminance ratio before and after the data extension. The converting unit 10 can improve the light use efficiency, thereby reducing the power consumption in the light source device 50.

In the example above, the converting unit 10 performs the color conversion step (Step S55) only on an area where the luminance difference with respect to the image data having the lowest saturation out of the image data included in the first color information constituting one frame of the input video signal exceeds the threshold of the luminance difference, thereby preventing the simultaneous contrast. Alternatively, the converting unit 10 may perform the color conversion step (Step S55) on the image data of the entire area constituting one frame of the input video signal such that the luminance ratio before and after the data extension step (Step S58) is equal to or smaller than a predetermined value. With this operation, the converting unit 10 can naturally prevent the simultaneous contrast.

The present embodiment provides the display device and the color conversion method that can improve the light use efficiency in the liquid crystal display panel.

Modifications

The display device 100 according to the embodiments above is what is called a transmissive liquid crystal display device including a back light device, such as the light source device 50, that outputs white light in a planar manner from the back surface of the image display unit 30, for example. In a case where the image display unit 30 is a transmissive liquid crystal display device, the display device 100 increases the degree of conversion in the color conversion under an environment having higher illuminance of external light, thereby increasing the light use efficiency in the entire image display unit 30. Thus, the display device 100 can improve the visibility. With this configuration, the display device 100 can increase the degree of reduction in the output from the light source device 50, thereby increasing the effect of reducing the power consumption in the light source device 50. This configuration is useful especially when it is necessary to reduce power consumption and/or heat generation in the output from the light source device 50, for example.

Figure 25:
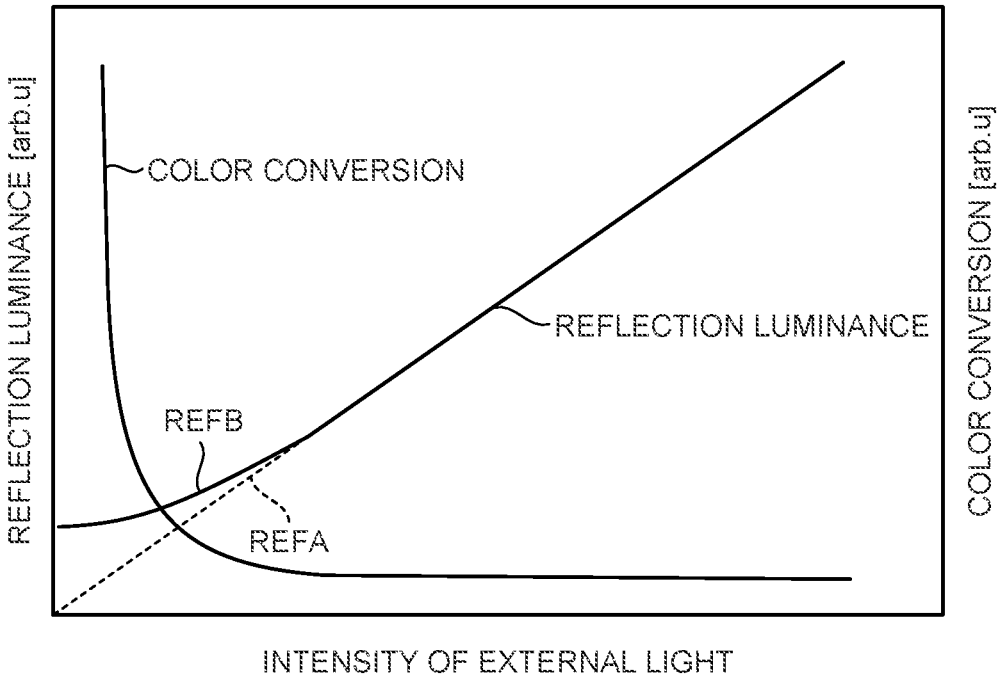
FIG. 25 is a diagram indicating the relation among the intensity of external light, reflection luminance, and color conversion according to a modification.
Figure 26:
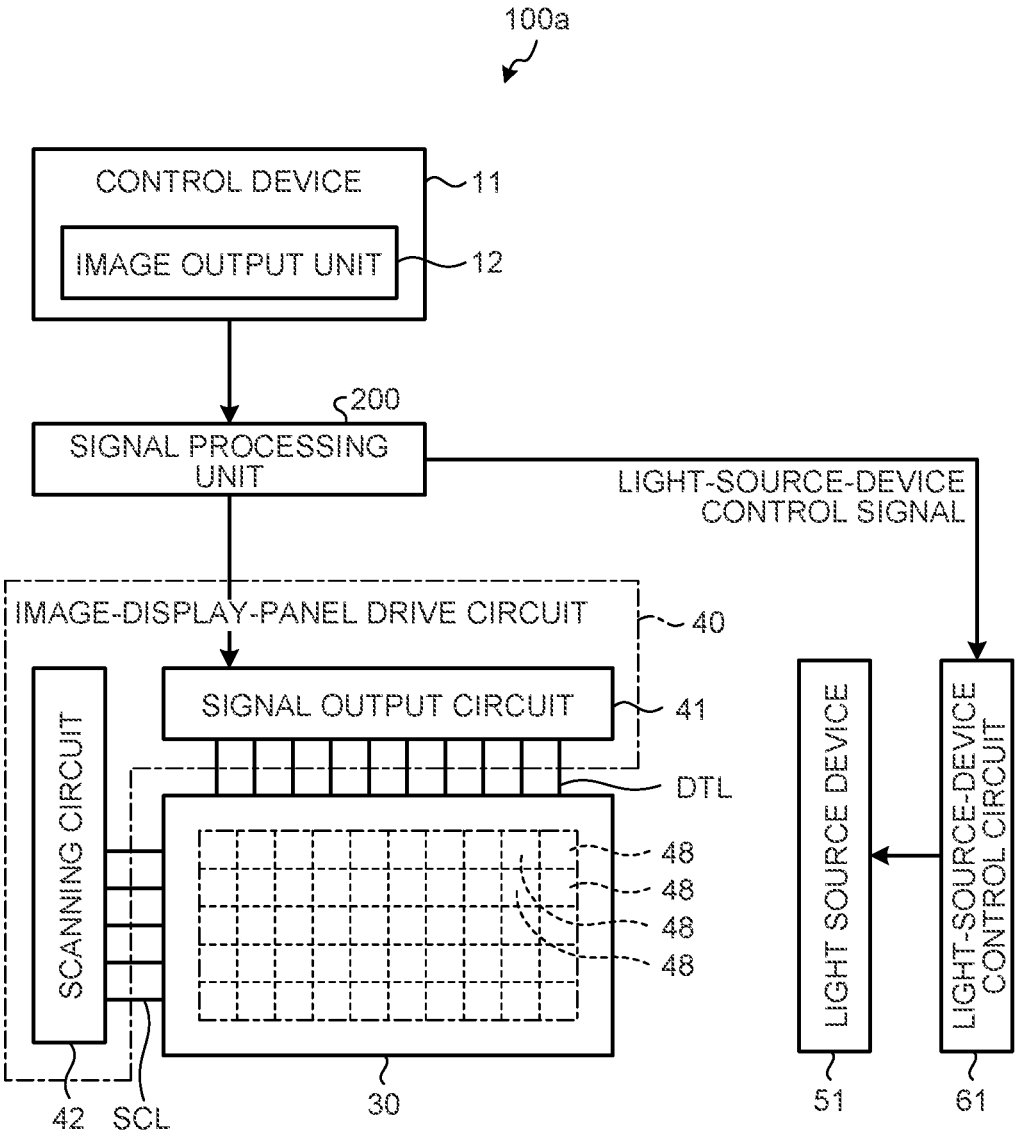
FIG. 26 is a block diagram of an exemplary configuration of a display device according to the modification.

The color conversion is also applicable to a case where the image display unit 30 is what is called a reflective liquid crystal display device. FIG. 25 is a diagram indicating the relation among the intensity of external light, reflection luminance, and color conversion according to a modification. FIG. 26 is a block diagram of an exemplary configuration of the display device according to the modification. Explanation of components identical to those in the configuration illustrated in FIG. 1 will be omitted.

As indicated by the dotted line (REFA) in FIG. 25, the reflection luminance of a reflective liquid crystal display device is proportional to the illuminance of external light (intensity of external light). In a case where the image display unit 30 is a reflective liquid crystal display device, the display device 100 increases the degree of conversion in the color conversion so as to increase the luminance under an environment having lower illuminance of external light (intensity of external light), thereby increasing the light use efficiency in the entire image display unit 30. Thus, the display device 100 can increase the reflectance, thereby improving the visibility (the solid line (REFB) in FIG. 25).

A display device 100*a* illustrated in FIG. 26 includes a light source device 51 serving as a front light device and outputs light from the front surface of the image display unit 30. A light-source-device control circuit 61 can reduce the output from the front light device (light source device 51) under an environment having lower intensity of light, thereby reducing the power consumption in the front light device (light source device 51).

The display device 100 according to the embodiments above is an RGBW display device in which the image display unit 30 includes the fourth sub-pixel 49W that displays the additional color component, for example. The present invention is also applicable to an RGB display device, for example. In this case, the display device performs data extension on the second input signal SRGB2 without performing the RGBW signal processing step, thereby producing the effect of reducing the power consumption in the light source device, such as a back light device and a front light device. Even in a case where the image display unit 30 is a reflective liquid crystal display device including no front light device, it is possible to increase the visibility under an environment having lower intensity of external light.

APPLICATION EXAMPLES

The following describes application examples of the display device 100 according to the first to the fifth embodiments and the modifications thereof with reference to FIGS. 27 to 35. The first to the fifth embodiments and the modifications thereof are hereinafter referred to as the present embodiment. FIGS. 27 to 35 are schematic views of examples of an electronic apparatus to which the display device according to the present embodiment is applied. The display device 100 according to the present embodiment is applicable to electronic apparatuses of all fields, such as portable electronic apparatuses including mobile phones and smartphones, television apparatuses, digital cameras, notebook personal computers, video cameras, and meters provided to a vehicle. In other words, the display device 100 according to the present embodiment is applicable to electronic apparatuses of all fields that display video signals received from the outside or video signals generated inside thereof as an image or video. The electronic apparatus includes a control device that supplies video signals to the display device 100 and controls the operation of the display device 100.

First Application Example

Figure 27:
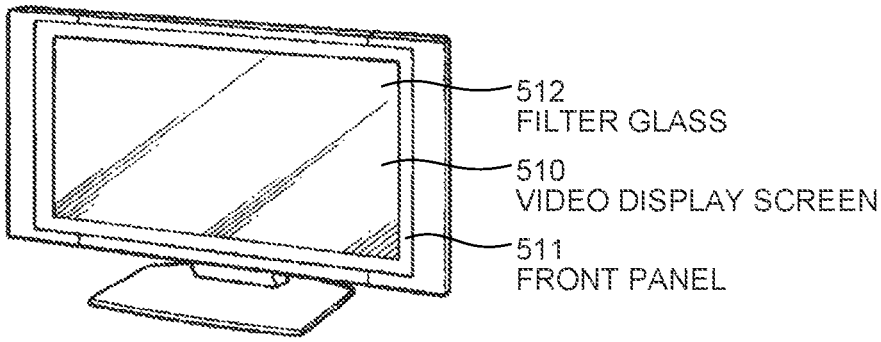
FIG. 27 is a schematic view of an example of an electronic apparatus to which the display device according to the present embodiment is applied.

An electronic apparatus illustrated in FIG. 27 is a television apparatus to which the display device 100 according to the present embodiment is applied. The television apparatus has a video display screen 510 including a front panel 511 and a filter glass 512, for example. The video display screen 510 corresponds to the display device 100 according to the present embodiment.

Second Application Example

Figure 28:
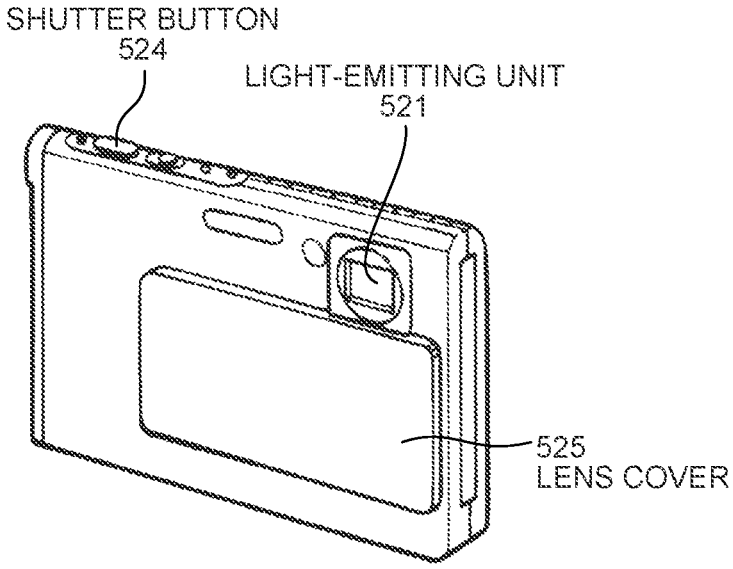
FIG. 28 is a schematic view of an example of an electronic apparatus to which the display device according to the present embodiment is applied.
Figure 29:
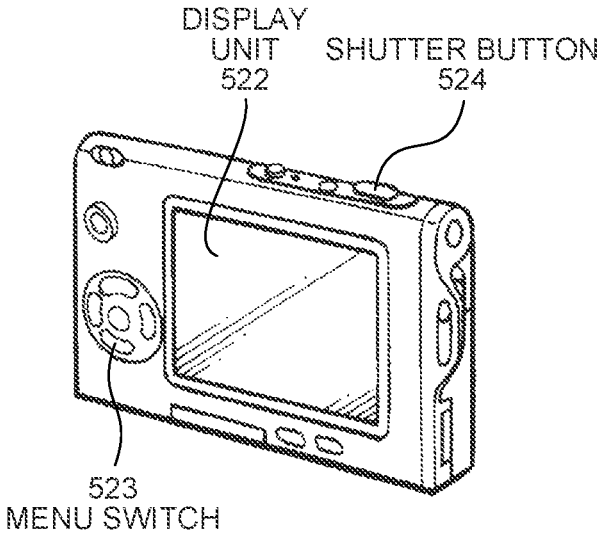
FIG. 29 is a schematic view of the example of the electronic apparatus to which the display device according to the present embodiment is applied.

An electronic apparatus illustrated in FIGS. 28 and 29 is a digital camera to which the display device 100 according to the present embodiment is applied. The digital camera includes a light-emitting unit 521 for flash, a display unit 522, a menu switch 523, and a shutter button 524, for example. The display unit 522 corresponds to the display device 100 according to the present embodiment. As illustrated in FIG. 28, the digital camera includes a lens cover 525. Sliding the lens cover 525 exposes a photographing lens. The digital camera captures light entering through the photographing lens, thereby taking a digital picture.

Third Application Example

Figure 30:
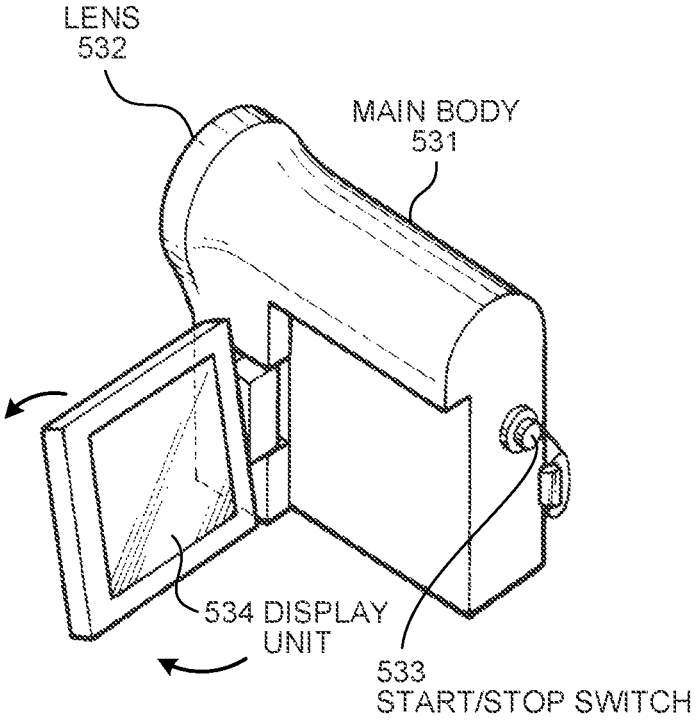
FIG. 30 is a schematic view of an example of an electronic apparatus to which the display device according to the present embodiment is applied.

An electronic apparatus illustrated in FIG. 30 is a video camera to which the display device 100 according to the present embodiment is applied. The video camera includes a main body 531, a lens 532 provided to the front side surface of the main body 531 and used for photographing a subject, a start/stop switch 533 used in photographing, and a display unit 534, for example. The display unit 534 corresponds to the display device 100 according to the present embodiment.

Fourth Application Example

Figure 31:
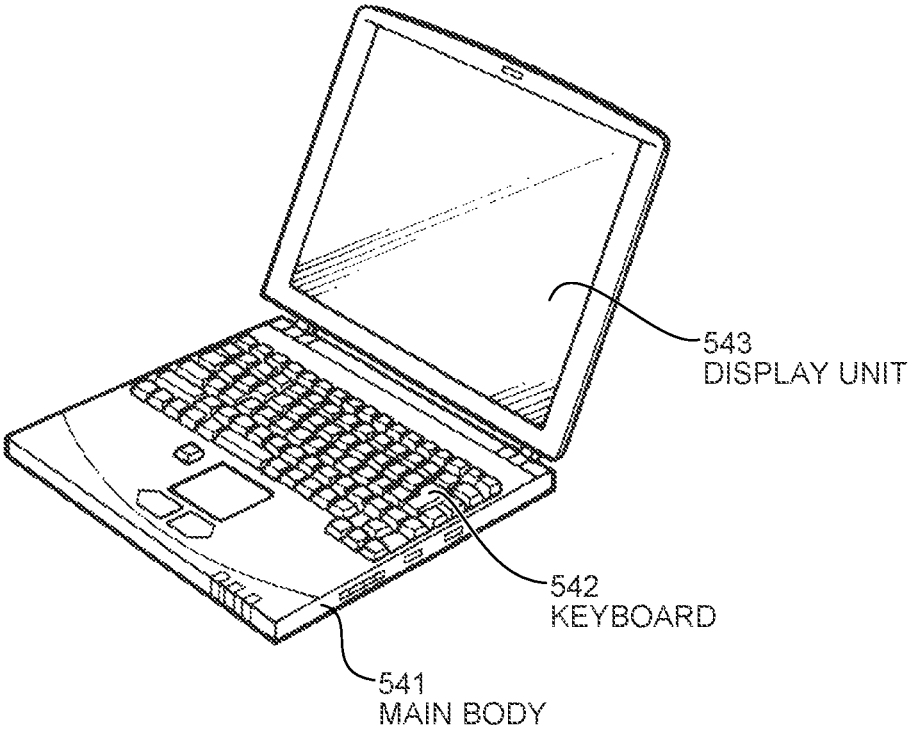
FIG. 31 is a schematic view of an example of an electronic apparatus to which the display device according to the present embodiment is applied.

An electronic apparatus illustrated in FIG. 31 is a notebook personal computer to which the display device 100 according to the present embodiment is applied. The notebook personal computer includes a main body 541, a keyboard 542 used for input of characters, and a display unit 543 that displays an image, for example. The display unit 543 corresponds to the display device 100 according to the present embodiment.

Fifth Application Example

Figure 32:
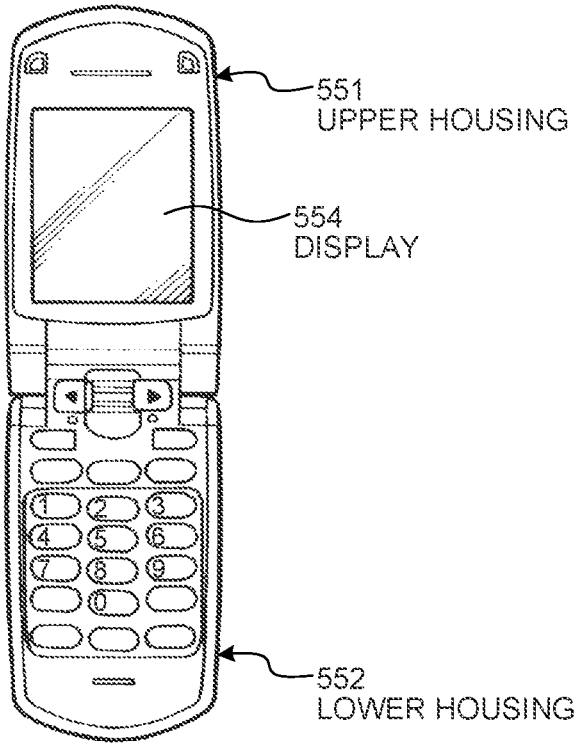
FIG. 32 is a schematic view of an example of an electronic apparatus to which the display device according to the present embodiment is applied.
Figure 33:
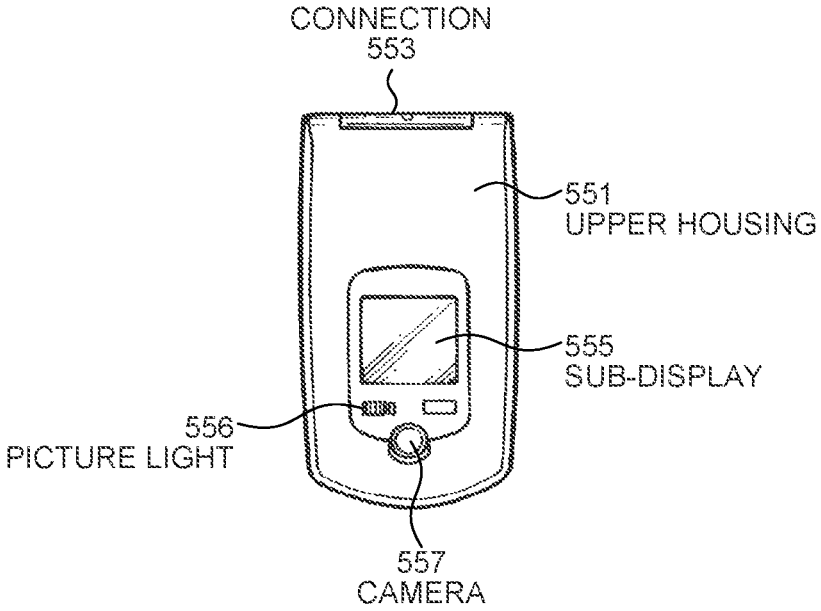
FIG. 33 is a schematic view of the example of the electronic apparatus to which the display device according to the present embodiment is applied.

An electronic apparatus illustrated in FIGS. 32 and 33 is a mobile phone to which the display device 100 is applied. FIG. 32 is a front view of the mobile phone in an unfolded state. FIG. 33 is a front view of the mobile phone in a folded state. The mobile phone includes an upper housing 551 and a lower housing 552 connected by a connection (hinge) 553, for example. The mobile phone further includes a display 554, a sub-display 555, a picture light 556, and a camera 557. The display 554 is provided with the display device 100. The display 554 of the mobile phone may also have a function to detect a touch besides a function to display an image.

Sixth Application Example

Figure 34:
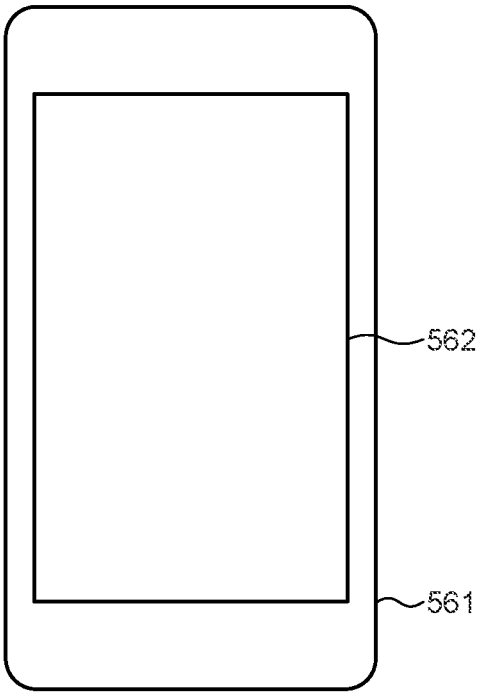
FIG. 34 is a schematic view of an example of an electronic apparatus to which the display device according to the present embodiment is applied.

An electronic apparatus illustrated in FIG. 34 is a portable information terminal that operates as a mobile computer, a multifunctional mobile phone, a mobile computer capable of making a voice call, or a mobile computer capable of performing communications and may be called a smartphone or a tablet terminal. The portable information terminal includes a display unit 562 on the surface of a housing 561, for example. The display unit 562 corresponds to the display device 100 according to the present embodiment.

Seventh Application Example

Figure 35:
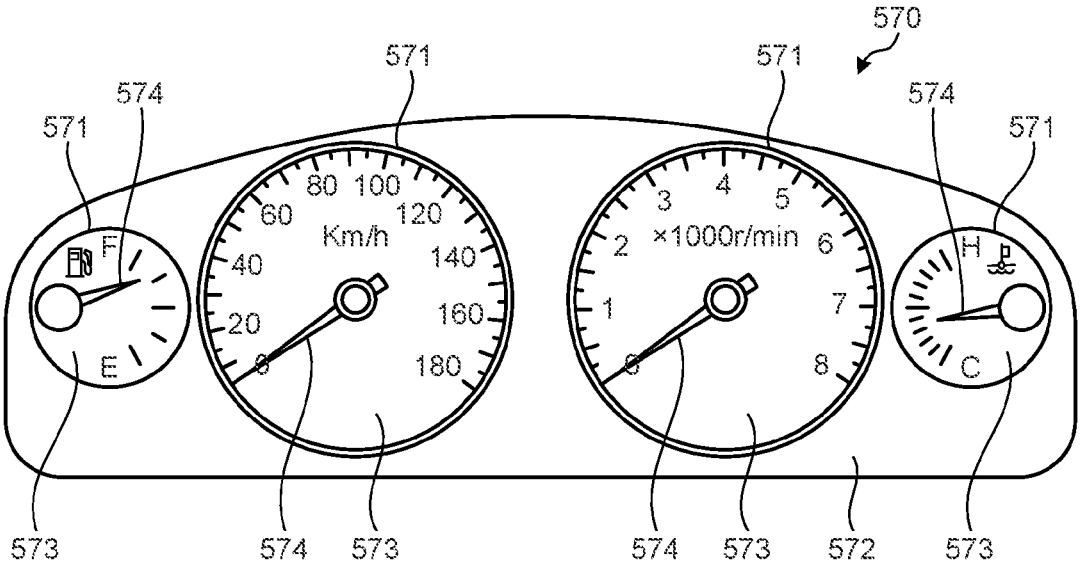
FIG. 35 is a schematic view of an example of an electronic apparatus to which the display device according to the present embodiment is applied.

FIG. 35 is a schematic view of a configuration of a meter unit according to the present embodiment. An electronic apparatus illustrated in FIG. 35 is a meter unit mounted on a vehicle. A meter unit (electronic apparatus) 570 illustrated in FIG. 35 includes a plurality of display devices 100 according to the present embodiment as display devices 571, such as a fuel gauge, a water temperature gauge, a speed meter, and a tachometer. The display devices 571 are covered with an exterior panel 572.

Each of the display devices 571 illustrated in FIG. 35 has an integrated configuration of a panel 573 serving as a display unit and a movement mechanism serving as an analog display unit. The movement mechanism includes a motor serving as a drive unit and an indicator 574 rotated by the motor. As illustrated in FIG. 35, each of the display devices 571 can display a gauge, a warning, and the like on the display surface of the panel 573 and rotate the indicator 574 of the movement mechanism on the display surface of the panel 573.

While the display devices 571 are provided to one exterior panel 572 in FIG. 35, the configuration is not limited thereto. One display device 571 may be provided to the area covered with the exterior panel 572 and display a fuel gauge, a water temperature gauge, a speed meter, and a tachometer, for example.

The contents described in the embodiments above are not intended to limit the present invention. The components according to the invention include components easily conceivable by those skilled in the art, components substantially identical therewith, and what is called equivalents. The components described above may be appropriately combined. Various omissions, substitutions, and changes of the components may be made without departing from the spirit of the invention.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A display device comprising:

an image display unit in which pixels each including a plurality of sub-pixels are arranged in a matrix, the sub-pixels displaying a plurality of color components; and a signal processing unit that performs color conversion on an input video signal and outputs the resultant signal to a drive circuit that controls drive of the image display unit, wherein the sub-pixels included in each pixel include a first sub-pixel that displays a red component;

a second sub-pixel that displays a green component;

a third sub-pixel that displays a blue component; and a fourth sub-pixel that is different from the first sub-pixel, the second sub-pixel, and the third sub-pixel, and displays an additional color component capable of being expressed by the first sub-pixel, the second sub-pixel, and the third sub-pixel, the signal processing unit performs color conversion on first color information in which at least one of a hue or saturation is reduced within an allowance range of a change in at least one of the hue or saturation so as to increase luminance, to generate second color information, the first color information being composed of three primary colors of red, green, and blue and derived based on the input video signal, the signal processing unit converts the second color information into third color information having the red component, the green component, the blue component, and the additional color component, the signal processing unit performs data extension on the third color information, and the signal processing unit performs the color conversion such that the additional color component of the third color information converted from the second color information is greater than the additional color component of the third color information converted directly from the first color information.

2. The display device according to claim 1, wherein light use efficiency when the additional color component is expressed by the fourth sub-pixel is higher than that when the additional color component is expressed by the first sub-pixel, the second sub-pixel, and the third sub-pixel.

3. The display device according to claim 2, wherein the image display unit is a transmissive liquid crystal display device, the display device further comprises:

a light source device that outputs light to an image display area of the image display unit from a back surface of the image display unit; and a light-source-device control circuit that controls an amount of light output from the light source device, to adjust luminance of an image to be displayed on the image display unit, and the signal processing unit performs data extension when generating the third color information and reduces the amount of light output from the light source device.

4. The display device according to claim 1, wherein, when a predictive value of power consumption obtained by performing an image analysis on all pixels in the first color information exceeds a power limit value, the signal processing unit performs the color conversion at a color conversion ratio associated with the predictive value of power consumption to generate the second color information.

5. The display device according to claim 4, wherein the signal processing unit calculates the predictive value of power consumption based on a set value of panel luminance that is received.

6. The display device according to claim 4, wherein the signal processing unit calculates the predictive value of power consumption in panel luminance setting based on illuminance of external light.

7. The display device according to claim 1, wherein the signal processing unit increases a degree of conversion in the color conversion as illuminance of external light is higher.

8. The display device according to claim 1, wherein the image display unit is a reflective liquid crystal display device, and the signal processing unit increases a degree of conversion in the color conversion as illuminance of external light is lower.

9. The display device according to claim 1, wherein the image display unit is a reflective liquid crystal display device, the display device further comprises:

a light source device that outputs light to an image display area of the image display unit from a display surface of the image display unit; and a light-source-device control circuit that controls an amount of light output from the light source device, to adjust luminance of an image to be displayed on the image display unit, and the signal processing unit increases a degree of conversion in the color conversion as illuminance of external light is lower.

10. The display device according to claim 1, wherein the signal processing unit performs an arithmetic operation to reduce the saturation with a saturation attenuation amount varying depending on the hue of the first color information.

11. The display device according to claim 10, wherein the signal processing unit performs the arithmetic operation to reduce the saturation with a larger saturation attenuation amount as the saturation of the first color information is lower.

12. A color conversion method for an input signal supplied to a drive circuit for an image display unit having a plurality of pixels each including a first sub-pixel that displays a red component, a second sub-pixel that displays a green component, a third sub-pixel that displays a blue component, and a fourth sub-pixel that is different from the first sub-pixel, the second sub-pixel, and the third sub-pixel, and displays an additional color component capable of being expressed by the first sub-pixel, the second sub-pixel, and the third sub-pixel, light use efficiency when the additional color component is expressed by the fourth sub-pixel being higher than that when the additional color component is expressed by the first sub-pixel, the second sub-pixel, and the third sub-pixel, the color conversion method comprising:

performing color conversion on first color information composed of three primary colors of red, green, and blue and derived based on an input video signal in which at least one of a hue or saturation is reduced within an allowance range of a change in at least one of the hue or saturation so as to increase luminance, to generate second color information;

converting the second color information into third color information having the red component, the green component, the blue component, and the additional color component; and performing data extension on the third color information, wherein the color conversion is performed such that the additional color component of the third color information converted from the second color information is greater than the additional color component of the third color information converted directly from the first color information.

* * * * *